US008729494B2

(12) United States Patent
Bateman

(10) Patent No.: US 8,729,494 B2
(45) Date of Patent: May 20, 2014

(54) ION SOURCE WITH DEVICE FOR OXIDISING A SAMPLE

(75) Inventor: Robert Harold Bateman, Cheshire (GB)

(73) Assignee: Micromas UK Limited, Wilmslow (GB)

( * ) Notice: Subject to any disclaimer, the term of this patent is extended or adjusted under 35 U.S.C. 154(b) by 658 days.

(21) Appl. No.: 13/054,171

(22) PCT Filed: Jul. 16, 2009

(86) PCT No.: PCT/GB2009/001753

§ 371 (c)(1), (2), (4) Date: Apr. 1, 2011

(87) PCT Pub. No.: WO2010/007368

PCT Pub. Date: Jan. 21, 2010

(65) Prior Publication Data

US 2011/0210242 A1 Sep. 1, 2011

Related U.S. Application Data

(60) Provisional application No. 61/082,249, filed on Jul. 21, 2008.

(30) Foreign Application Priority Data

Jul. 16, 2008 (GB) ..... 0813060.1

(51) Int. Cl.
*H01J 27/02* (2006.01)

(52) U.S. Cl.
USPC ..... 250/423 R; 250/424; 250/427; 250/281; 250/282

(58) Field of Classification Search
None
See application file for complete search history.

(56) References Cited

U.S. PATENT DOCUMENTS

| | | | | |
|---|---|---|---|---|
| 4,886,966 | A * | 12/1989 | Matsunaga et al. | 250/288 |
| 5,808,416 | A * | 9/1998 | Armini | 315/111.81 |
| 6,867,415 | B2 * | 3/2005 | Hughey et al. | 250/288 |
| 2002/0086434 | A1 | 7/2002 | Roussis et al. | |
| 2003/0044994 | A1 | 3/2003 | Bandura et al. | |
| 2003/0052266 | A1 * | 3/2003 | Shimomura et al. | 250/281 |
| 2007/0102634 | A1 * | 5/2007 | Frey et al. | 250/288 |
| 2008/0272285 | A1 * | 11/2008 | Giannantonio et al. | 250/281 |

FOREIGN PATENT DOCUMENTS

DE 116510 11/1975

(Continued)

OTHER PUBLICATIONS

PCT/ISA/273, WO, Jul. 27, 2010, Written Opinion for PCT/GB2009/001753.

PCT/ISA/237, WO, Jul. 27, 2010, ISR for PCT/GB2009/001753.

Qiao, etal., "MALDI In-Source Photooxidation Reactions for Online Peptide Tagging", Angewandte Chemie International Edition, 2008, pp. 2646-2648, vol. 47, Wiley-VCH Verlag GmbH & Co.

(Continued)

*Primary Examiner* — Andrew Smyth
(74) *Attorney, Agent, or Firm* — Diederiks & Whitelaw, PLC

(57) ABSTRACT

An ion source is disclosed wherein a sample is introduced into the sample chamber of the ion source in the gas phase via a sample introduction capillary tube. The sample is directed onto a heated surface coated with an oxidizing reagent such as copper oxide. Carbon in the sample is oxidized to form carbon dioxide. The resulting carbon dioxide molecules are then ionised by electron impact ionization with an electron beam and the resulting ions are passed to a mass analyzer for mass analysis.

14 Claims, 12 Drawing Sheets

(56) References Cited

FOREIGN PATENT DOCUMENTS

| | | | | |
|---|---|---|---|---|
| EP | 0453190 | | 10/1991 | |
| EP | 453190 | A2 * | 10/1991 | ..... G01N 27/70 |
| EP | 0902283 | | 3/1999 | |
| JP | 7037546 | | 2/1995 | |
| JP | 2000002699 | | 1/2000 | |
| WO | 02/090959 | | 11/2002 | |

OTHER PUBLICATIONS

Kántor, et al., "Halogenation with CCI4, and CF2CI2 vapours in arc emission spectometry", Spectrochimica Acta, 1980, pp. 401-420, vol. 35B, Pergamon Press Ltd., Great Britain.

* cited by examiner

FIG. 1

| Element | Symbol | Mass | Column A No of atoms | Column B No of atoms | Column C No of atoms |
|---|---|---|---|---|---|
| Carbon | C | 12.0000 | 1 - 20 | 1 - 20 | 1 - 20 |
| Hydrogen | H | 1.0078 | 0 - 40 | 0 - 40 | 0 - 40 |
| Oxygen | O | 15.9949 | 0 - 10 | 0 - 10 | 0 - 10 |
| Nitrogen | N | 14.0031 | 0 - 10 | 0 - 10 | 0 - 10 |
| Sulphur | S | 31.9721 | 0 - 10 | 0 - 10 | 1 - 3 |
| Phosphorus | P | 30.9738 | 0 - 10 | 0 - 10 | 0 - 10 |
| Fluorine | F | 18.9984 | 0 - 10 | 0 - 10 | 0 - 10 |
| Chlorine | Cl | 34.9689 | 0 - 10 | 0 | 0 |
| Bromine | Br | 78.9184 | 0 - 10 | 0 | 0 |
| **Mass Da** | **Mass Tolerance mDa (+/-)** | **Mass Tolerance ppm (+/-)** | **Number of Compositions** | **Number of Compositions** | **Number of Compositions** |
| 250.000 | 300 | 1200 | 10,823 | 5,383 | 2,651 |
| 250.000 | 50 | 200 | 4,827 | 2,736 | 1,411 |
| 250.000 | 20 | 80 | 2,007 | 1,172 | 588 |
| 250.000 | 10 | 40 | 1,005 | 598 | 297 |
| 250.000 | 5 | 20 | 502 | 294 | 143 |
| 250.000 | 2 | 8 | 216 | 122 | 64 |
| 250.000 | 1 | 4 | 108 | 60 | 30 |

FIG. 2

| | | | Column A | Column B | Column C |
|---|---|---|---|---|---|
| Element | Symbol | Mass | No of atoms | No of atoms | No of atoms |
| Carbon | C | 12.0000 | 1 - 40 | 1 - 40 | 1 - 40 |
| Hydrogen | H | 1.0078 | 0 - 80 | 0 - 80 | 0 - 80 |
| Oxygen | O | 15.9949 | 0 - 10 | 0 - 10 | 0 - 10 |
| Nitrogen | N | 14.0031 | 0 - 10 | 0 - 10 | 0 - 10 |
| Sulphur | S | 31.9721 | 0 - 10 | 0 - 10 | 0 - 3 |
| Phosphorus | P | 30.9738 | 0 - 10 | 0 - 10 | 0 - 10 |
| Fluorine | F | 18.9984 | 0 - 10 | 0 - 10 | 0 - 10 |
| Chlorine | Cl | 34.9689 | 0 - 10 | 0 | 0 |
| Bromine | Br | 78.9184 | 0 - 10 | 0 | 0 |
| Mass Da | Mass Tolerance mDa (+/-) | Mass Tolerance ppm (+/-) | Number of Compositions | Number of Compositions | Number of Compositions |
| 500.000 | 600 | 1200 | 534,676 | 116,228 | 84,283 |
| 500.000 | 100 | 200 | 189,433 | 56,624 | 45,535 |
| 500.000 | 50 | 100 | 92,876 | 29,416 | 24,281 |
| 500.000 | 20 | 40 | 36,893 | 11,910 | 9,910 |
| 500.000 | 10 | 20 | 18,434 | 5,960 | 4,968 |
| 500.000 | 5 | 10 | 9,236 | 3,007 | 2,503 |
| 500.000 | 2 | 4 | 3,662 | 1,189 | 989 |
| 500.000 | 1 | 2 | 1,828 | 586 | 495 |

FIG. 3

| | | | Column B | Column C | Column D | Column E |
|---|---|---|---|---|---|---|
| Element | Symbol | Mass | No of atoms | No of atoms | No of atoms | No of atoms |
| Carbon | C | 12.0000 | 1 - 20 | 1 - 20 | 5 - 10 | 5 - 10 |
| Hydrogen | H | 1.0078 | 0 - 40 | 0 - 40 | 8 - 14 | 8 - 14 |
| Oxygen | O | 15.9949 | 0 - 10 | 0 - 10 | 0 - 10 | 1 - 3 |
| Nitrogen | N | 14.0031 | 0 - 10 | 0 - 10 | 1 - 3 | 1 - 3 |
| Sulphur | S | 31.9721 | 0 - 10 | 1 - 3 | 1 - 3 | 1 - 3 |
| Phosphorus | P | 30.9738 | 0 - 10 | 0 - 10 | 1 - 2 | 1 - 2 |
| Fluorine | F | 18.9984 | 0 - 10 | 0 - 10 | 0 | 0 |
| Chlorine | Cl | 34.9689 | 0 | 0 | 0 | 0 |
| Bromine | Br | 78.9184 | 0 | 0 | 0 | 0 |
| Mass Da | Mass Tolerance mDa (+/-) | Mass Tolerance ppm (+/-) | Number of Compositions | Number of Compositions | Number of Compositions | Number of Compositions |
| 250.000 | 300 | 1200 | 5,383 | 2,651 | 27 | 16 |
| 250.000 | 50 | 200 | 2,736 | 1,411 | 27 | 16 |
| 250.000 | 20 | 80 | 1,172 | 588 | 14 | 6 |
| 250.000 | 10 | 40 | 598 | 297 | 8 | 3 |
| 250.000 | 5 | 20 | 294 | 143 | 3 | 2 |
| 250.000 | 2 | 8 | 122 | 64 | 1 | 1 |
| 250.000 | 1 | 4 | 60 | 30 | 1 | 1 |

FIG. 4

| | | | Column B | Column C | Column D | Column E |
|---|---|---|---|---|---|---|
| Element | Symbol | Mass | No of atoms | No of atoms | No of atoms | No of atoms |
| Carbon | C | 12.0000 | 1 - 40 | 1 - 40 | 13 - 22 | 15 - 20 |
| Hydrogen | H | 1.0078 | 0 - 80 | 0 - 80 | 13 - 22 | 15 - 20 |
| Oxygen | O | 15.9949 | 0 - 10 | 0 - 10 | 0 - 10 | 0 - 10 |
| Nitrogen | N | 14.0031 | 0 - 10 | 0 - 10 | 2 - 5 | 2 - 5 |
| Sulphur | S | 31.9721 | 0 - 10 | 0 - 3 | 1 - 2 | 1 - 2 |
| Phosphorus | P | 30.9738 | 0 - 10 | 0 - 10 | 2 - 5 | 2 - 5 |
| Fluorine | F | 18.9984 | 0 - 10 | 0 - 10 | 0 | 0 |
| Chlorine | Cl | 34.9689 | 0 | 0 | 0 | 0 |
| Bromine | Br | 78.9184 | 0 | 0 | 0 | 0 |
| Mass Da | Mass Tolerance mDa (+/-) | Mass Tolerance ppm (+/-) | Number of Compositions | Number of Compositions | Number of Compositions | Number of Compositions |
| 500.000 | 600 | 1200 | 116,228 | 84,283 | 183 | 60 |
| 500.000 | 100 | 200 | 56,624 | 45,535 | 183 | 60 |
| 500.000 | 50 | 100 | 29,416 | 24,281 | 152 | 55 |
| 500.000 | 20 | 40 | 11,910 | 9,910 | 73 | 30 |
| 500.000 | 10 | 20 | 5,960 | 4,968 | 37 | 16 |
| 500.000 | 5 | 10 | 3,007 | 2,503 | 18 | 7 |
| 500.000 | 2 | 4 | 1,189 | 989 | 7 | 2 |
| 500.000 | 1 | 2 | 586 | 495 | 4 | 1 |

ION SOURCE WITH DEVICE FOR OXIDISING A SAMPLE

CROSS REFERENCE TO RELATED APPLICATIONS

This application is the National Stage of International Application No. PCT/GB09/001,753, filed Jul. 16, 2009, and designating the United States, which claims benefit of and priority to U.S. Provisional Patent Application No. 61/082,249, filed Jul. 21, 2008, and United Kingdom Patent Application No. 0813060.1, filed Jul. 16, 2008. The entire contents of these applications are incorporated herein by reference.

BACKGROUND OF THE INVENTION

The present invention relates to an ion source, a mass spectrometer, an elemental analyser, a method of ionising a sample, a method of mass spectrometry and a method of elemental analysis of a sample.

A principal use of mass spectrometers is to determine the mass to charge ratio of ions generated from an unknown substance in order to provide information from which to aid the identification of the substance. Where the unknown substance comprises one or more organic compounds it is commonly necessary to determine the elemental composition of these compounds. This information is helpful, and often essential, for the identification of the organic compounds present in the unknown substance.

The measurement of the mass of an organic compound is rarely adequate information from which to determine the elemental composition of the compound. The element carbon may combine with any or all of the elements hydrogen, nitrogen, oxygen, sulphur, phosphorous, fluorine, chlorine and bromine (which are the most common constituents of organic compounds) in numerous different proportions so that it is likely that an organic compound with a given nominal molecular weight will have a large number of possible elemental compositions.

The different isotopes of the different elements do not have precise integer masses but instead have a small mass sufficiency or deficiency (of the order of +/− a few hundredths of a mass unit) with respect to its nominal or integer mass. Hence, the exact mass of an organic molecule is not an integer and is generally not precisely the same as those of other organic molecules with the same nominal or integer mass. Hence, if the measurement of the molecular weight is made to a higher accuracy it is possible to eliminate a large number of possible elemental compositions that have the same nominal or integer mass. Accurate mass determination reduces the number of possible elemental compositions, and the more accurate the mass determination the smaller the number of possible elemental compositions.

Inspection of the isotopic distribution of the molecular ion may also help to reduce the number of possible elemental compositions. For example, the presence of chlorine and/or bromine is usually easily recognised since these elements have very distinct isotope distributions. The isotope ratio for chlorine, $Cl^{35}/Cl^{37}$, is approximately 3, and the isotope ratio for bromine, $Br^{79}/Br^{81}$, is approximately 1, both of which are quite different to those of other commonly occurring elements in organic compounds. The element sulphur also has a relatively distinctive isotope ratio. The ratio $S^{32}/S^{34}$ is approximately 22.5 and with careful measurements of the isotope ratios of a molecular ion it is sometimes possible to determine if sulphur atoms are present in the molecule, and if so approximately how many. However, it is considerably more difficult to determine if sulphur is present or not if the molecules of interest also contain either or both of chlorine and bromine. Information regarding the likely number of chlorine and bromine atoms in the molecule, or in the absence of chlorine and bromine, the range within which the number of sulphur atoms are likely to be present in the molecule, will help reduce the number of possible elemental compositions for an unknown organic molecule analysed by mass spectrometry.

Apart from the determination of the likely number of chlorine and/or bromine atoms in each molecule, or, in the absence of chlorine and bromine, the determination to a lower precision of the approximate number of sulphur atoms in each molecule, it is very difficult or impossible to determine anything very useful from the molecular ion isotope distribution about the presence and relative numbers of the other common elements occurring in organic compounds. In particular, fluorine and phosphorous are mono-isotopic and hydrogen, nitrogen and oxygen have very low abundance secondary isotopes, and their presence in an organic molecule is not revealed in its molecular ion distribution.

When necessary, it is common practice to resort to other techniques in order to determine the elemental composition of an unknown organic compound. For example, elemental analysers may be used to determine the presence of certain types of element in the molecule.

There are several known methods for elemental analysis. In the more common types of elemental analyser a sample to be analyzed is weighed into a disposable tin or aluminium capsule. The sample is injected into a high temperature furnace and combusted in pure oxygen under static conditions. At the end of the combustion period, a dynamic burst of oxygen is added to ensure total combustion of all inorganic and organic substances. If tin capsules are used for the sample container, an initial exothermic reaction occurs raising the temperature of combustion to over 1800° C.

The resulting combustion products pass through specialized reagents to produce from the elemental carbon, hydrogen, and nitrogen: carbon dioxide ($CO_2$), water ($H_2O$), nitrogen ($N_2$) and N oxides. These reagents also remove all other interferences including halogens, sulphur and phosphorus. The gases are then passed over copper to scrub excess oxygen, and to reduce oxides of nitrogen to elemental nitrogen.

The resulting mixture of gases may then be separated, for example by gas chromatography and/or may be analysed, for example, using specific detectors. The gas mixture may be measured using a series of high-precision thermal conductivity detectors, each containing a pair of thermal conductivity cells. A water trap is provided between the first two cells. The differential signal between the cells is proportional to the water concentration which is a function of the amount of hydrogen in the original sample. A carbon dioxide trap is provided between the next two cells for measuring carbon. Finally, nitrogen is measured against a helium reference.

Sulphur is commonly measured separately, as sulphur dioxide, by replacing the combustion and reduction reagents. Oxygen is also commonly measured separately by pyrolysis in the presence of platinized carbon. The oxygen is finally measured as carbon dioxide.

Known elemental analysers are not particularly sensitive when compared with that commonly achieved by mass spectrometry. Typically 1-5 mg of sample is required, or more for samples with low carbon content. The analysis time is quite long, typically of the order of 5 minutes for carbon, hydrogen and nitrogen analysis. Hence, the technique is too slow to be used when directly coupled to gas or liquid chromatography. Hence the sample needs to be purified separately before analysis. Furthermore, if the sample is in solution, as would be the case for separation by liquid chromatography, it is necessary to isolate, collect and desolvate a sample before submission for elemental analysis.

More recently the technique of gas chromatography combustion isotope ratio mass spectrometry (GCC-IRMS) has been developed wherein a mixture of organic materials are separated by gas chromatography, combusted to carbon dioxide, water and other oxides, and the $^{13}C/^{12}C$ isotope ratio is then measured by isotope ratio mass spectrometry. The effluent from a gas chromatography capillary column is arranged to first enter a motorised valve to allow solvent to be diverted to waste to prevent premature depletion of the combustion reactor. The analytes eluting from the capillary column are then directed to an alumina or quartz combustion tube loaded with an oxidising reagent such as copper oxide (CuO), nickel oxide (NiO) or zinc oxide (ZnO). A mixture of oxidising reagents may be used and a catalytic material may also be added. For example, the combustion tube may be loaded with a twisted strand of copper, platinum and nickel wires. The combustion tube is heated, typically to between 900° C. and 950° C., and is periodically recharged with oxygen to convert the surface layers of the copper wire to copper oxide and the nickel wire to nickel oxide. Following combustion, the effluent is dried in a Nafion® water trap or cryogenic water trap and the dried effluent is admitted to the isotope ratio mass spectrometer.

In comparison to elemental analysis isotope ratio mass spectrometry (EA-IRMS), the GCC-IRMS method requires lower levels of analyte i.e. nanomoles versus micromoles of carbon. It is also faster with the gas-phase combustion process occurring on a millisecond time scale. GCC-IRMS has proven to be adequate for fast GC detection thereby providing the convenience of on-line isolation of components. However, this method is not appropriate for the measurement of the isotope ratios of all the elements commonly occurring in organic compounds and for similar reasons it is not appropriate for the elemental analysis of organic compounds.

In summary, accurate mass measurement of an organic compound using mass spectrometry is, in itself, rarely adequate for determining the elemental composition of the organic compound. The determination of the elemental composition is aided by the information gained from separate measurements, such as the information gained from measurements with an elemental analyser. However, elemental analysers are relatively insensitive and are relatively slow. If the sample is a mixture of organic compounds, as the vast majority of samples are, then it is necessary to isolate the components of the mixture prior to the elemental analysis. The speed of the elemental analyser does not allow on-line interfacing to chromatography. Furthermore, liquid chromatography would require the additional process of removing solvent before submission of the effluent material to the elemental analyser. The methods employed in GCC-IRMS allow on-line interfacing to gas chromatography, and provide improved sensitivity, but are not suitable for elemental analysis. The methods employed in GCC-IRMS are also not appropriate to liquid chromatography since it is necessary to remove all solvent material before submission of the effluent material to the combustion chamber. Finally, there is no method for the elemental analysis of ionised organic molecules, or for the elemental analysis of fragment ions, daughter ions, or decomposition or reaction product ions of organic molecules.

It is desired to provided an improved apparatus and method for determining the elemental composition of an organic compound and/or for determining an isotope ratio of one or more elements present in an organic compound.

SUMMARY OF THE INVENTION

According to an aspect of the present invention there is provided an ion source comprising:

a source chamber; and a first device located within the source chamber which is arranged and adapted to at least in part fully oxidise, fluorinate, chlorinate or halogenate a sample which is introduced, in use, into the source chamber.

The sample preferably comprises an organic sample.

According to the preferred embodiment sample molecules or sample ions are preferably combusted upon impacting the first device which is preferably heated. At least some of the elements in the sample molecules or sample ions are fully oxidised i.e. carbon is converted into carbon dioxide molecules and hydrogen is converted into water molecules.

According to another embodiment there is provided apparatus comprising a chamber and a first device located within the chamber wherein the first device is arranged and adapted to oxidise, fluorinate, chlorinate or halogenate sample molecules or sample ions which are caused to impact the first device and wherein the chamber and/or the first device are maintained at a pressure below atmospheric pressure and further preferably are maintained at a pressure $\leq 10^{-5}$ mbar. It will be apparent that the apparatus is maintained at a much lower pressure than conventional combustion sources which are typically maintained at atmospheric pressure. Furthermore, the apparatus preferably further comprises an electron beam within the chamber which preferably ionises the gaseous products resulting from the oxidisation, fluorination, chlorination or halogenation of the sample molecules or sample ions by the first device.

The ion source preferably further comprises a second device located within the source chamber which is arranged and adapted to at least in part fully oxidise, fluorinate, chlorinate or halogenate a sample which is introduced, in use, into the source chamber. The second device is preferably spaced apart from the first device or comprises a separate region or portion of the first device.

The phrase "at least in part fully oxidise, fluorinate, chlorinate or halogenate a sample" is intended to include some sample molecules or ions comprising carbon being full converted to carbon dioxide (rather than carbon monoxide).

According to the preferred embodiment the source chamber is preferably located in a vacuum chamber which is preferably maintained, in use, at a pressure selected from the group consisting of: (i) $\leq 10^{-5}$ mbar; (ii) $\leq 10^{-6}$ mbar; (iii) $\leq 10^{-7}$ mbar; (iv) $\leq 10^{-8}$ mbar; and (v) $\leq 10^{-9}$ mbar.

At least one surface of the first device and/or the second device preferably comprises one or more oxidising reagents for oxidising the sample. The one or more oxidising reagents are preferably selected from the group consisting of: (i) antimony oxide ($Sb_2O_3$); (ii) arsenic oxide ($As_2O_5$); (iii) cobalt oxide ($Co_3O_4$); (iv) copper oxide (CuO); (v) iridium oxide ($IrO_2$); (vi) iron oxide ($Fe_3O_4$); (vii) lead oxide ($Pb_3O_4$); (viii) lead oxide ($PbO_2$); (ix) palladium oxide (PdO); (x) potassium oxide ($K_2O$); (xi) rhodium oxide ($Rh_2O_3$); (xii) silver oxide ($Ag_2O$); (xiii) sodium peroxide ($Na_2O_2$); (xiv) tellurium oxide ($TeO_2$); (xv) tin oxide (SnO); (xvi) chromium oxide ($CrO_2$); (xvii) chromium oxide ($Cr_2O_5$); (xviii) germanium oxide (GeO); (xix) iridium oxide ($Ir_2O_3$); (xx) lead oxide ($Pb_2O_3$); (xxi) manganese oxide ($Mn_2O_3$); (xxii) manganese oxide ($MnO_2$); (xxiii) molybdenum oxide ($MoO_2$); (xxiv) nickel oxide ($Ni_2O_3$); (xxv) platinum oxide (PtO); (xxvi) rhenium oxide ($ReO_2$); (xxvii) rhenium oxide ($ReO_3$); (xxviii) rubidium oxide ($Rb_2O$); (xxix) ruthenium oxide ($RuO_2$); (xxx) tungsten oxide ($WO_2$); and (xxxi) zinc oxide (ZnO).

According to the preferred embodiment at least one surface of the first device and/or the second device comprises one or more fluorinating reagents for fluorinating the sample. The one or more fluorinating reagents are preferably selected from the group consisting of: (i) copper fluoride ($CuF_2$); (ii) iridium fluoride ($IrF_3$); (iii) manganese fluoride ($MnF_3$); (iv) niobium fluoride ($NbF_4$); (v) ruthenium fluoride ($RuF_3$); (vi) thallium fluoride ($TlF_3$); (vii) titanium fluoride ($TiF_3$); (viii) tungsten fluoride ($WF_3$); (ix) vanadium fluoride ($VF_4$); and (x) nickel fluoride ($NiF_6$, $NiF_4$, $NiF_3$).

According to the preferred embodiment at least one surface of the first device and/or the second device comprises one or more chlorinating reagents for chlorinating the sample.

According to the preferred embodiment at least one surface of the first device and/or the second device comprises one or more halogenating reagents for halogenating the sample.

According to the preferred embodiment at least one surface of the first device and/or the second device comprises a catalytic material. The catalytic material preferably comprises one or more elements selected from the group consisting of: (i) nickel; (ii) platinum; (iii) palladium; (iv) rhodium; and (v) a transition element.

According to the preferred embodiment at least one surface of the first device and/or the second device is porous or sintered.

According to the preferred embodiment the first device comprises a heating element for heating a surface of the first device to a temperature selected from the group consisting of: (i) ≥150°; (ii) ≥200°; (iii) ≥250°; (iv) ≥300°; (v) ≥350°; (vi) ≥400°; (vii) ≥450°; (viii) ≥500°; (ix) ≥550°; (x) ≥600°; (xi) ≥650°; (xii) ≥700°; (xiii) ≥750°; (xiv) ≥800°; (xv) ≥850°; (xvi) ≥900°; (xvii) ≥950°; and (xviii) ≥1000°.

According to the preferred embodiment the second device comprises a heating element for heating a surface of the second device to a temperature selected from the group consisting of: (i) ≥150°; (ii) ≥200°; (iii) ≥250°; (iv) ≥300°; (v) ≥350°; (vi) ≥400°; (vii) ≥450°; (viii) ≥500°; (ix) ≥550°; (x) ≥600°; (xi) ≥650°; (xii) ≥700°; (xiii) ≥750°; (xiv) ≥800°; (xv) ≥850°; (xvi) ≥900°; (xvii) ≥950°; and (xviii) ≥1000°.

The ion source preferably further comprises a device for generating an electron beam, wherein the electron beam is arranged to ionise at least some gaseous products resulting from sample molecules or sample ions impacting the first device and/or the second device and becoming oxidised and/or fluorinated and/or chlorinated and/or halogenated.

The ion source preferably further comprises a first capillary or introduction tube through which:

(i) a sample in a liquid or gaseous state is introduced, in use, into the source chamber; and/or (ii) a purging gas is introduced in a mode of operation prior to, with or subsequent to the introduction of the sample into the source chamber; and/or (iii) oxygen and/or fluorine and/or chlorine and/or a halogen is introduced in a mode of operation in order to recharge a surface of the first device and/or the second device.

The ion source preferably further comprises a second capillary or introduction tube through which:

(i) a sample in a liquid or gaseous state is introduced, in use, into the source chamber; and/or (ii) a purging gas is introduced in a mode of operation prior to, with or subsequent to the introduction of the sample into the source chamber; and/or (iii) oxygen and/or fluorine and/or chlorine and/or a halogen is introduced in a mode of operation in order to recharge a surface of the first device and/or the second device.

According to a less preferred embodiment the ion source may further comprise a vacuum insertion probe for introducing a solid into the source chamber. The vacuum insertion probe is preferably heated in use.

According to the preferred embodiment the ion source further comprises a first ion inlet through which sample ions are introduced into the ion source. Sample ions are preferably introduced into the ion source via the first ion inlet and are directed onto the first device and/or the second device and wherein the first device and/or the second device is arranged and adapted to oxidise, fluorinate, chlorinate or halogenate the sample ions.

In a first mode of operation sample ions may be arranged to enter the source chamber and wherein at least some or, at least 5%, 10%, 15%, 20%, 25%, 30%, 35%, 40%, 45%, 50%, 55%, 60%, 65%, 70%, 75%, 80%, 85%, 90%, 95% or 100% of the sample ions are directed on to the first device and/or the second device and wherein in a second mode of operation sample ions may be arranged to enter the source chamber and wherein at least some or at least 5%, 10%, 15%, 20%, 25%, 30%, 35%, 40%, 45%, 50%, 55%, 60%, 65%, 70%, 75%, 80%, 85%, 90%, 95% or 100% of the sample ions are arranged to be transmitted through the source chamber without being directed on to the first device and/or the second device.

The ion source preferably further comprises one or more electrodes for directing sample ions onto the first device and/or the second device.

According to the preferred embodiment in a mode of operation sample ions are directed onto the first device and/or the second device, preferably by the one of more electrodes, at an incident angle (preferably measured relative to the surface of the first device and/or the second device) of: (i) <15°; (ii) 15-30°; (iii) 30-45°; (iv) 45-60°; (v) 60-75°; and (vi) >75°.

According to the preferred embodiment in a mode of operation sample ions are directed onto the first device and/or the second device, preferably by the one of more electrodes, with an ion energy selected from the group consisting of: (i) <1 eV; (ii) <3 eV; (iii) <10 eV; (iv) <30 eV; (v) <100 eV; (vi) <300 eV; (vii) <1000 eV; (viii) >1 eV; (ix) >3 eV; (x) >10 eV; (xi) >30 eV; (xii) >100 eV; (xiii) >300 eV; and (xiv) >1000 eV.

The sample ions may comprise fragment, daughter or product ions of a sample material.

According to another aspect of the present invention there is provided a mass spectrometer or an elemental analyser comprising an ion source as described above.

According to another aspect of the present invention there is provided a method of ionising a sample comprising:

providing a source chamber;

introducing a sample into the source chamber; and using a first device located within the source chamber to at least in part fully oxidise, fluorinate, chlorinate or halogenate the sample.

According to another aspect of the present invention there is provided a method of mass spectrometry comprising a method as described above.

According to an aspect of the present invention there is provided a method of analysing a sample comprising:

introducing a sample into an ion source;

at least in part fully oxidising, fluorinating, chlorinating or halogenating the sample using a first device to produce gaseous oxidised, fluorinated, chlorinated or halogenated products; and ionising at least some of the gaseous oxidised, fluorinated, chlorinated or halogenated products to form a plurality of analyte ions.

The method preferably further comprises mass analysing the analyte ions.

The sample preferably comprises an organic sample.

According to an embodiment the method further comprises determining an isotope ratio of one or more elements present in the sample from the mass analysis of the analyte ions. The elements are preferably selected from the group consisting of: (i) carbon; (ii) hydrogen; (iii) nitrogen; (iv) oxygen; and (v) sulphur. Other embodiments are contemplated wherein the element may comprise chlorine or bromine.

According to an embodiment the isotope ratio comprises the ratio of two or more isotopes selected from the group consisting: (i) $C^{12}$; (ii) $C^{13}$; and (iii) $C^{14}$.

According to an embodiment:

(i) the first device is arranged and adapted to at least in part fully oxidise the sample; and/or (ii) the gaseous oxidised products include carbon dioxide ($CO_2$); and/or (iii) the isotope ratio comprises the ratio $C^{14}/C^{12}$; and/or (iv) the isotope ratio is determined by analysing the intensity of $C^{14}O^{16}{}_2$ having a nominal mass to charge ratio of 46 to the intensity of $C^{12}O^{16}{}_2$ having a nominal mass to charge ratio of 44.

Other less preferred embodiments are contemplated wherein other ratios may be determined such as the ratio of $C^{14}/C^{13}$ and/or $C^{13}/C^{12}$ and/or $C^{14}/C^{13}/C^{12}$.

According to the preferred embodiment both naturally occurring isotopes and isotopes such as $C^{14}$ which may have been artificially introduced into a sample may be measured. $C^{14}$ isotopes may, for example, have been introduced into a sample as part of a chemical or metabolic study of the sample.

According to an embodiment:

(i) the first device is arranged and adapted to at least in part fully fluorinate the sample; and/or (ii) the gaseous oxidised products include carbon tetrafluoride ($CF_4$); and/or (iii) the isotope ratio comprises the ratio $C^{14}/C^{12}$; and/or (iv) the isotope ratio is determined by analysing the intensity of $C^{14}F^{16}{}_4$ having a nominal mass to charge ratio of 90 to the intensity of $C^{12}F^{16}{}_4$ having a nominal mass to charge ratio of 88.

Other less preferred embodiments are contemplated wherein other ratios may be determined such as the ratio of $C^{14}/C^{13}$ and/or $C^{13}/C^{12}$ and/or $C^{14}/C^{13}/C^{12}$.

According to an embodiment:

(i) the first device is arranged and adapted to at least in part fully iodinate the sample; and/or (ii) the gaseous oxidised products include carbon tetraiodide ($Cl_4$); and/or (iii) the isotope ratio comprises the ratio $C^{14}/C^{12}$; and/or (iv) the isotope ratio is determined by analysing the intensity of $C^{14}I^{127}{}_4$ having a nominal mass to charge ratio of 522 to the intensity of $C^{12}I^{127}{}_4$ having a nominal mass to charge ratio of 520.

Other less preferred embodiments are contemplated wherein other ratios may be determined such as the ratio of $C^{14}/C^{13}$ and/or $C^{13}/C^{12}$ and/or $C^{14}/C^{13}/C^{12}$.

The method preferably further comprises measuring ion currents for ions of each mass to charge ratio of interest.

The method preferably further comprises processing the measured ion currents for ions of each mass to charge ratio of interest by:

(a) subtracting a background spectrum or ion current; and/or (b) correcting measured ion currents for variations in response for ions of different mass to charge values.

According to another embodiment of the present invention the method further comprises a method of elemental analysis of the sample.

The method preferably further comprises measuring, determining or estimating the relative abundances of some or all of different elements present in an organic molecule or ions derived from an organic molecule.

According to an embodiment the method further comprises utilising the measurement, determination or estimation of the relative abundances of some or all of different elements present in the organic molecule to provide limits to, or to filter, the results of an elemental composition calculation derived from the measured mass or the accurate mass of an organic molecule or of an ion derived from an organic molecule.

The elements are preferably selected from the group consisting of: (i) carbon; (ii) hydrogen; (iii) nitrogen; (iv) oxygen; (v) sulphur; (vi) phosphorus; (vii) fluorine; (viii) chlorine; and (ix) bromine.

According to an aspect of the present invention there is provided apparatus for analysing a sample comprising:

an ion source into which a sample is introduced in use;

a first device for at least in part fully oxidising, fluorinating, chlorinating or halogenating the sample to produce gaseous oxidised, fluorinated, chlorinated or halogenated products; and a device for ionising at least some of the gaseous oxidised, fluorinated, chlorinated or halogenated products to form a plurality of analyte ions.

The apparatus preferably further comprises a mass analyser for mass analysing the analyte ions.

According to an aspect of the present invention there is provided an isotope ratio mass spectrometer comprising apparatus as described above.

According to an aspect of the present invention there is provided an elemental analyser comprising apparatus as described above.

According to an aspect of the present invention there is provided a computer program executable by the control system of a mass spectrometer comprising an ion source comprising a source chamber and a first device located within the source chamber, the computer program being arranged to cause the control system:

to cause a sample which is introduced into the source chamber to be at least in part fully oxidised, fluorinated, chlorinated or halogenated by the first device.

According to an aspect of the present invention there is provided a computer program executable by the control system of a mass spectrometer, the computer program being arranged to cause the control system:

(i) to cause a sample to be at least in part fully oxidised, fluorinated, chlorinated or halogenated by a first device to produce gaseous oxidised, fluorinated, chlorinated or halogenated products;

(ii) to cause a device to ionise at least some of the gaseous oxidised, fluorinated, chlorinated or halogenated products to form a plurality of analyte ions; and (iii) to cause a mass analyser to mass analyse the analyte ions.

According to an aspect of the present invention there is provided a computer readable medium comprising computer executable instructions stored on the computer readable medium, the instructions being arranged to be executable by a control system of a mass spectrometer comprising an ion source comprising a source chamber and a first device located within the source chamber, the computer program being arranged to cause the control system:

to cause a sample which is introduced into the source chamber to be at least in part fully oxidised, fluorinated, chlorinated or halogenated by the first device.

According to an aspect of the present invention there is provided a computer readable medium comprising computer executable instructions stored on the computer readable medium, the instructions being arranged to be executable by a control system of a mass spectrometer, the computer program being arranged to cause the control system:

(i) to cause a sample to be at least in part fully oxidised, fluorinated, chlorinated or halogenated by a first device to produce gaseous oxidised, fluorinated, chlorinated or halogenated products;

(ii) to cause a device to ionise at least some of the gaseous oxidised, fluorinated, chlorinated or halogenated products to form a plurality of analyte ions; and (iii) to cause a mass analyser to mass analyse the analyte ions.

The computer readable medium is preferably selected from the group consisting of:

(i) a ROM; (ii) an EAROM; (iii) an EPROM; (iv) an EEPROM; (v) a flash memory; (vi) an optical disk; (vii) a RAM; and (viii) a hard disk drive.

According to another aspect of the present invention there is provided an apparatus comprising:

a source chamber;

a first ion inlet through which sample ions are introduced, in use, into the source chamber;

a first device located within the source chamber which is arranged and adapted to at least in part fully oxidise, fluorinate, chlorinate or halogenate the sample ions, wherein the source chamber is located in a vacuum chamber which is maintained, in use, at a pressure selected from the group consisting of: (i) $\leq 10^{-5}$ mbar; (ii) $\leq 10^{-6}$ mbar; (iii) $\leq 10^{-7}$ mbar; (iv) $\leq 10^{-8}$ mbar; and (v) $\leq 10^{-9}$ mbar; and a device for generating an electron beam, wherein the electron beam is arranged to ionise at least some gaseous products resulting from the sample ions impacting the first device and becoming oxidised and/or fluorinated and/or chlorinated and/or halogenated.

According to another aspect of the present invention there is provided a method comprising:

providing a source chamber;

introducing sample ions into the source chamber;

using a first device located within the source chamber to at least in part fully oxidise, fluorinate, chlorinate or halogenate the sample ions, wherein the source chamber is located in a vacuum chamber which is maintained at a pressure selected from the group consisting of: (i) $\leq 10^{-5}$ mbar; (ii) $\leq 10^{-6}$ mbar; (iii) $\leq 10^{-7}$ mbar; (iv) $\leq 10^{-8}$ mbar; and (v) $\leq 10^{-9}$ mbar; and generating an electron beam, wherein the electron beam is arranged to ionise at least some gaseous products resulting from the sample ions impacting the first device and becoming oxidised and/or fluorinated and/or chlorinated and/or halogenated.

A method of chemical analysis is preferably provided wherein the organic molecules of an organic substance, or ions derived from the organic molecules, are reacted with a chemical reagent within the vacuum system of a mass spectrometer to yield a plurality of small molecules (e.g. carbon dioxide) comprised of one or more constituent atoms of the organic molecules or ions derived from the organic molecules, and one or more atoms of the chemical reagent. For example, a substantial proportion of the organic molecules are fully oxidised thereby yielding a plurality of relatively small gaseous molecules such as carbon dioxide from oxidation of the carbon atoms from which the organic molecules were comprised. The plurality of small molecules are then preferably analysed by the mass spectrometer.

In a preferred embodiment, the small molecules that result from the reaction of the chemical reagent with the organic molecules or ions derived from the organic molecules, and which comprise more than one constituent atom of the organic molecule or ions derived from the organic molecules, are comprised of constituent atoms of the same element (e.g. water molecules from the oxidation of the hydrogen atoms from which the organic molecules were comprised).

In a preferred embodiment, the analysis of the small molecules by the mass spectrometer provides information which may be used to determine some or all of the different elements present in the organic molecules or ions derived from the organic molecules, and furthermore, an estimation of the relative abundance of the elements in the organic molecules or ions derived from the organic molecules.

The chemical reagent preferably comprises an oxidising reagent and the atoms of the chemical reagent preferably comprise oxygen atoms.

The oxidising chemical reagent preferably comprises one or more of: (i) antimony oxide ($Sb_2O_3$); (ii) arsenic oxide ($As_2O_5$); (iii) cobalt oxide ($Co_3O_4$); (iv) copper oxide (CuO); (v) iridium oxide ($IrO_2$); (vi) iron oxide ($Fe_3O_4$); (vii) lead oxide ($Pb_3O_4$); (viii) lead oxide ($PbO_2$); (ix) palladium oxide (PdO); (x) potassium oxide ($K_2O$); (xi) rhodium oxide ($Rh_2O_3$); (xii) silver oxide ($Ag_2O$); (xiii) sodium peroxide ($Na_2O_2$); (xiv) tellurium oxide ($TeO_2$); (xv) tin oxide (SnO); (xvi) chromium oxide ($CrO_2$); (xvii) chromium oxide ($Cr_2O_5$); (xviii) germanium oxide (GeO); (xix) iridium oxide ($Ir_2O_3$); (xx) lead oxide ($Pb_2O_3$); (xxi) manganese oxide ($Mn_2O_3$); (xxii) manganese oxide ($MnO_2$); (xxiii) molybdenum oxide ($MoO_2$); (xxiv) nickel oxide ($Ni_2O_3$); (xxv) platinum oxide (PtO); (xxvi) rhenium oxide ($ReO_2$); (xxvii) rhenium oxide ($ReO_3$); (xxviii) rubidium oxide ($Rb_2O$); (xxix) ruthenium oxide ($RuO_2$); (xxx) tungsten oxide ($WO_2$); and (xxxi) zinc oxide (ZnO).

The chemical reagent may comprise a halogenating reagent and the atoms of the chemical reagent may comprise halogen atoms.

The chemical reagent may comprise a fluorinating reagent and the atoms of the chemical reagent may comprise fluorine atoms.

The fluorinating chemical reagent is preferably one or more of: (i) copper fluoride ($CuF_2$); (ii) iridium fluoride ($IrF_3$); (iii) manganese fluoride ($MnF_3$); (iv) niobium fluoride ($NbF_4$); (v) ruthenium fluoride ($RuF_3$); (vi) thallium fluoride ($TlF_3$); (vii) titanium fluoride ($TiF_3$); (viii) tungsten fluoride ($WF_3$); (ix) vanadium fluoride ($VF_4$); and (x) nickel fluoride ($NiF_6$, $NiF_4$, $NiF_3$).

The chemical reagent may comprise chlorinating reagent and the atoms of the chemical reagent may comprise chlorine atoms.

According to an embodiment of the present invention the chemical reagent is in the form of, or is present on, a surface. The chemical reagent preferably decomposes when heated. The chemical reagent preferably thermally decomposes at a temperature below which it melts or sublimes in vacuum. The surface is preferably rough or porous or sintered The surface is preferably heated. The surface is preferably heated to a temperature greater than: (i) 200° C.; (ii) 250° C.; (iii) 300° C.; (iv) 350° C.; (v) 400° C.; (vi) 450° C.; (vii) 500° C.; (viii) 550° C.; (ix) 600° C.; (x) 650° C.; (xi) 700° C.; (xii) 750° C.; (xiii) 800° C.; (xiv) 850° C.; (xv) 900° C.; (xvi) 950° C.; and (xvii) 1000° C.

In an embodiment of the present invention the chemical reagent forms, or is deposited on, the surface of a dispenser cathode.

In another embodiment of the present invention the surface includes a catalytic material. The catalytic material preferably includes one or more of: (i) nickel; (ii) platinum; (iii) palladium; (iv) rhodium; and (v) a transition element.

In a preferred embodiment of the present invention the small molecules are further ionised prior to analysis by mass spectrometry. The small molecules may be ionised by Electron impact (EI) ionisation and/or by Thermal Ionisation (TI)

In a preferred embodiment of the present invention the heated chemically reactive surface, and subsequent means for ionisation, are maintained at high vacuum. The pressure in the high vacuum is preferably less than (i) $10^{-6}$ mbar; (ii) $10^{-7}$ mbar; (iii) $10^{-8}$ mbar; and (iv) $10^{-9}$ mbar.

In an alternative embodiment of the present invention the heated chemically reactive surface, and subsequent means for ionisation, are preferably continuously purged by a flow of an inert or un-reactive gas. The inert or un-reactive gas is preferably one or more of: (i) helium; (ii) neon; (iii) argon; and (iv) a noble gas. The pressure of the inert or un-reactive gas is preferably less than: (i) $10^{-2}$ mbar; (ii) $10^{-3}$ mbar; (iii) $10^{-4}$ mbar; and (iv) $10^{-5}$ mbar.

In a preferred embodiment of the present invention the ions formed from the small molecules are mass analysed by a mass spectrometer. The mass spectrometer is preferably (i) a quadrupole mass filter; (ii) a 3D or Paul ion trap; (iii) a linear quadrupole ion trap; (iv) a Time of Flight mass spectrometer; (v) an orthogonal acceleration time of Flight mass spectrometer; (vi) a magnetic sector; (vii) an electrostatic ion trap mass analyser utilising Fourier Transform (FT); (viii) a magnetic ion trap utilising Fourier Transform (FT); (ix) an Orbitrap®; and (x) a Fourier Transform Ion Cyclotron Resonance (FT-ICR) mass spectrometer.

The mass spectrometer preferably comprises a magnetic sector incorporating multiple detectors to allow simultaneous detection of ions of more than one mass to charge ratio value.

In a preferred embodiment of the present invention the measured ion currents for ions of each mass to charge ratio value of interest acquired by the mass spectrometer are processed such as to perform any or all of the following functions: (a) subtraction of background spectrum or ion current; (b) correction of measured ion currents for variations in response for ions of different mass to charge values; where variations in response for ions of different mass to charge ratio values are the products of variations in any or all of (i) variations in ionisation efficiency, (ii) variations in ion transmission efficiency, (iii) variations in relative ion sampling times or ion transmission and detection duty cycles, (iv) variations in ion detection efficiencies; (c) measurement of the relative abundances of ions of the small molecules comprising different elements present in the organic molecule or ions derived from the organic molecule; (d) determinations or estimations of the relative abundances of some or all of the different elements present in the organic molecules or ions derived from the organic molecules; and (e) utilisation of determinations or estimations of relative abundances of some or all of the different elements present in the organic molecules to provide limits to, or to filter, the results of an elemental composition calculation derived from the measured mass, or preferably the accurate mass, of an organic molecule, or of an ion derived from the organic molecule In another embodiment of the present invention the measured ion currents for ions of each mass to charge ratio value of interest acquired by the mass spectrometer are processed such as to perform any or all of the following functions: (a) subtraction of background spectrum or current; (b) correction of measured currents for variations in response for ions of different mass to charge ratio values; where variations in response for ions of different mass to charge ratio values are the products of variations in any or all of: (i) variations in ionisation efficiency; (ii) variations in ion transmission efficiency; (iii) variations in ion sampling times or ion transmission and detection duty cycles; and (iv) variations in ion detection efficiencies; and (c) measurement of the relative isotope abundance ratios for one or more of the elements present in the organic molecules or ions derived from the organic molecules.

In a preferred embodiment of the present invention the organic molecules are preferably introduced directly into the vacuum system of the mass spectrometer. The organic molecules are preferably introduced through a capillary tube or through one or more apertures into the vacuum system of the mass spectrometer. The stream of organic molecules preferably form a molecular beam that is directed at the heated chemically reactive surface.

In another preferred embodiment of the present invention the organic molecules are ionised before being exposed to the heated chemically reactive surface. The ions are preferably directed at the surface of the heated chemically reactive surface. The ions preferably impact the heated chemically reactive surface at an incident angle (measured relative to the plane of the reactive surface) of: (i) less than 15°; (ii) between 15° and 30°; (iii) between 30° and 45°; (iv) between 45° and 60°; (v) between 60° and 75°; and (vi) greater than 75°. The energy of the ions is preferably: (i) less than 1 eV; (ii) less than 3 eV; (iii) less than 10 eV; (iv) less than 30 eV; (v) less than 100 eV; (vi) less than 300 eV; (vii) less than 1000 eV; (viii) greater than 1 eV; (ix) greater than 3 eV; (x) greater than 10 eV; (xi) greater than 30 eV; (xii) greater than 100 eV; (xiii) greater than 300 eV; and (xiv) greater than 1000 eV.

In another preferred embodiment of the present invention the organic molecules are preferably ionised before being exposed to the heated chemically reactive surface by: (i) Electron Impact (EI) ionisation; (ii) Chemical Ionisation (CI); (iii) Field Ionisation (FI); (iv) Field Desorption (FD) Ionisation; (v) Fast Atom Bombardment (FAB); (vi) Liquid SIMS; (vii) Atmospheric Pressure Ionisation (API); (viii) Electrospray Ionisation (ESI); (ix) Atmospheric Pressure Chemical Ionisation (APCI); (x) Atmospheric Pressure Photo-Ionisation (APPI); (xi) Laser Desorption Ionisation; (xii) Matrix Assisted Laser Desorption Ionisation (MALDI); and (xiii) Desorption Electrospray Ionisation (DESI).

In another embodiment of the present invention the ions derived from the organic molecules are, prior to exposure to the heated chemically reactive surface: (a) selected according to their mass to charge ratio values, where ion selection according to mass to charge ratio value utilises: (i) a quadrupole mass filter; (ii) a Wien filter; (iii) a magnetic sector; (iv) a linear or 3D ion trap; (v) a Time-of-Flight mass spectrometer; (b) selected according to their ion mobility, where ion selection according to ion mobility utilises: (i) a drift tube; (ii) a travelling wave; or (c) selected according to their differential ion mobility, where ion selection according to their differential ion mobility utilises: (i) a Differential Mobility Spectrometer (DMS); (ii) a Field Asymmetric Ion Mobility Spectrometer (FAIMS).

In another embodiment of the present invention the ions derived from the organic molecules are, prior to exposure to the heated chemically reactive surface, partially fragmented or decomposed, or reacted. The ions are preferably partially fragmented or decomposed or reacted by: (i) collision with gas molecules or atoms; (ii) collisions with an inert or unreactive surface; (iii) collisions with electrons; (iv) Electron Capture Dissociation (ECD); (v) collisions with ions; (vi) Electron Transfer Dissociation (ETD); (v) collisions with metastable atoms; (vi) collisions with metastable molecules; and (vii) collisions with metastable ions.

In another embodiment of the present invention the organic molecules are first separated or purified by gas chromatography, liquid chromatography or capillary electrophoresis.

According to an embodiment of the present invention a mass spectrometer is provided wherein the mass spectrometer further comprises an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source.

The mass spectrometer preferably further comprises one or more continuous or pulsed ion sources.

The mass spectrometer preferably further comprises one or more ion guides.

The mass spectrometer preferably further comprises one or more ion mobility separation devices and/or one or more Field Asymmetric Ion Mobility Spectrometer devices.

The mass spectrometer preferably further comprises one or more ion traps or one or more ion trapping regions.

The mass spectrometer preferably further comprises one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The mass spectrometer preferably further comprises a mass analyser selected from the group consisting of: (i) a quadrupole, mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) a double focusing magnetic sector mass analyser; (viii) Ion Cyclotron Resonance ("ICR") mass analyser; (ix) a Fourier Transform Ion Cyclotron Resonance ("FTICR") mass analyser; (x) an electrostatic or orbitrap mass analyser; (xi) a Fourier Transform electrostatic or orbitrap mass analyser; (xii) a Fourier Transform mass analyser; (xiii) a Time of Flight mass analyser; (xiv) an orthogonal acceleration Time of Flight mass analyser; and (xv) a linear acceleration Time of Flight mass analyser.

The mass spectrometer preferably further comprises one or more energy analysers or electrostatic energy analysers.

The mass spectrometer preferably further comprises one or more ion detectors.

The mass spectrometer preferably further comprises one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter.

The mass spectrometer preferably further comprises a device or ion gate for pulsing ions.

The mass spectrometer preferably further comprises a device for converting a substantially continuous ion beam into a pulsed ion beam.

According to an embodiment the mass spectrometer further comprises a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser.

According to an embodiment the mass spectrometer further comprises a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

BRIEF DESCRIPTION OF THE DRAWINGS

Various embodiments of the present invention will now be described, by way of example, and with reference to the accompanying drawings in which:

FIG. 1 shows the number of elemental compositions that comply with the valency laws that are possible for an organic compound having a mono-isotopic mass of 250.0 Daltons and comprising up to nine specific elements, and the number of atoms of those elements which may be present in a molecule of the compound;

FIG. 2 shows the number of elemental compositions that comply with the valency laws that are possible for an organic compound having a mono-isotopic mass of 500.0 Daltons and comprising up to nine specific elements, and the number of atoms of those elements which may be present in a molecule of the compound;

FIG. 3 shows the number of elemental compositions that comply with the valency laws that are possible for an organic compound having a mono-isotopic mass of 250.0 Daltons and comprising up to seven specific elements, and the number of atoms of those elements which may be present in a molecule of the compound;

FIG. 4 shows the number of elemental compositions that comply with the valency laws that are possible for an organic compound having a mono-isotopic mass of 500.0 Daltons and comprising up to seven specific elements, and the number of atoms of those elements which may be present in a molecule of the compound;

DETAILED DESCRIPTION OF THE PREFERRED EMBODIMENTS

Figure 5:
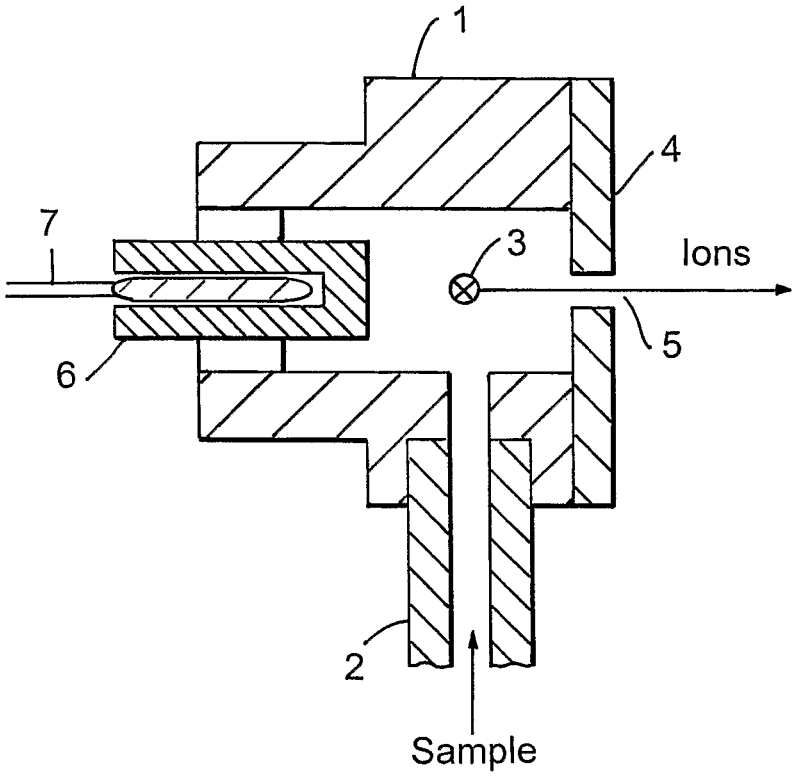
FIG. 5 shows an embodiment of the present invention wherein a sample is introduced into an ion source in the gas phase.

An embodiment of the present invention will now be described. FIG. 1 shows the number of possible elemental compositions that comply with the valency laws that are possible for an organic compound having a mono-isotopic mass of 250.000 Daltons. Column A tabulates the minimum and maximum number of atoms of the elements carbon, hydrogen, oxygen, nitrogen, sulphur, phosphorous, fluorine, chlorine and bromine that have been considered as being potentially present in the molecule. The number of elemental compositions that have a monoisotopic molecular mass that falls within the indicated mass search window expressed in milli-Dalton (mDa) and in parts per million (ppm) are also shown. In column A, the monoisotopic mass of molecules with between 1 and 20 carbon atoms and up to 40 hydrogen atoms, up to 10 oxygen atoms, up to 10 nitrogen atoms, up to 10 sulphur atoms, up to 10 phosphorus atoms, up to 10 fluorine atoms, up to 10 chlorine atoms and up to 10 bromine atoms has been calculated. The number of elemental compositions of molecules with a monoisotopic mass of 250.000 and which fall within a mass search window of +/−0.300 Da has been calculated to be 10,823. Similarly 4,827 elemental compositions were found to fall within a mass search window of +/−0.050 Da, 2,007 elemental compositions were found to fall within a mass search window of +/−0.020 Da, 1,005 elemental compositions were found to fall within a mass search window of +/−0.010 Da, 502 elemental compositions were found to fall within a mass search window of +/−0.005 Da, 216 elemental compositions were found to fall within a mass search window of +/−0.002 Da and 108 elemental compositions were found to fall within a mass search window of +/−0.001. It is clear that as the accuracy of the measurement of the mass of the ion improves a smaller mass search window may be used and a smaller number of possible elemental compositions are possible.

For the elements considered in FIG. 1 the maximum and minimum mass for any molecule with a nominal mass of 250 Da will fall within the range 250.000+/−0.300 Da. Hence, in the calculation for a search window of +/−0.3 Da the mass search window has not eliminated any elemental compositions that yield a molecule with a nominal mass of 250 Da. A search window of +/−0.05 Da has eliminated approximately half the elemental compositions that are possible without this restriction. A search window of +/−0.02 Da has eliminated approximately 80% the elemental compositions that are possible without this restriction.

Some types of mass spectrometer are capable of measuring the mass of an ion with an accuracy of about +/−1 ppm (+/−one standard deviation or 68% confidence). Under situations where enough sample and enough time is available to achieve a mass accuracy of about +/−1 ppm (68% confidence) then a mass search window of +/−4 ppm or +/−0.001 Da may be set. In this case, the number of possible elemental compositions is reduced to 108. However, 108 possible elemental compositions is still a long way short of the target of just one possible elemental composition.

The elements chlorine and bromine have noticeably different isotope ratios to those of the other elements that have been considered. The isotope ratio for chlorine $Cl^{35}/Cl^{37}$ is approximately 3 and the isotope ratio for bromine $Br^{79}/Br^{81}$ is approximately 1. Hence, it is often possible to recognise if atoms of chlorine and/or bromine are present in the molecule. If atoms of chlorine and/or bromine are present then the number of such atoms per molecule may be determined from a measurement of the isotope ratios for the molecular ion. Column B in FIG. 1 tabulates the minimum and maximum number of atoms of the same elements that have been considered to be present in the molecule and also tabulates the number of elemental compositions that have a monoisotopic molecular mass that falls within the indicated mass search window expressed in milli-Dalton (mDa) and in parts per million (ppm). In this instance, it has been assumed that as a consequence of inspecting the molecular isotopic distribution, it has been possible to conclude that the molecule contains no atoms of chlorine or bromine. It will be seen that as a consequence of this assumption, the number of possible elemental compositions is now approximately half that for each mass search window where previously chlorine and bromine have not been eliminated from the calculation.

The element sulphur also has a relatively distinctive isotope ratio, although far less distinctive than that of chlorine and bromine. The ratio $S^{32}/S^{34}$ is approximately 22.5 and with careful measurements of the isotope ratios of a molecular ion it is possible to determine if sulphur atoms are present in the molecule and if so approximately how many. Column C in FIG. 1 tabulates the minimum and maximum number of atoms of the same elements that have been considered to be present in the molecule and then tabulates the number of elemental compositions that have a monoisotopic molecular mass that falls within the indicated mass search window. In this instance it has been assumed that as a consequence of careful measurement of the molecular isotopic distribution, it has been possible to conclude that the molecule contains no atoms of chlorine or bromine and between one and three atoms of sulphur. It will be seen that, as a consequence of this assumption, the number of possible elemental compositions has now approximately halved yet again for each mass search window.

In this situation, where the mass has been accurately measured and the search window has been set to +/−4 ppm or +/−0.001 Da, the number of possible elemental compositions is reduced to 30. This is considerably less than the 108 possible elemental compositions first calculated but is still short of the target of just one possible elemental composition.

The table shown in FIG. 2 is similar to that shown in FIG. 1 but shows the number of possible elemental compositions that comply with the valency laws that are possible for an organic compound having a mono-isotopic mass of 500.000 Daltons. As for FIG. 1, column A in FIG. 2 tabulates the minimum and maximum number of atoms of the elements carbon, hydrogen, oxygen, nitrogen, sulphur, phosphorous, fluorine, chlorine and bromine that have been considered to be present in the molecule and then tabulates the number of elemental compositions that have a monoisotopic molecular mass that falls within the indicated mass search window expressed in milli-Dalton (mDa) and in parts per million (ppm). Hence, in column A, the monoisotopic mass of molecules with between 1 and 40 carbon atoms, up to 80 hydrogen atoms, and up to 10 oxygen atoms, up to 10 nitrogen atoms, up to 10 sulphur atoms, up to 10 phosphorus atoms, up to 10 fluorine atoms, up to 10 chlorine atoms and up to 10 bromine atoms have been calculated. The number of elemental compositions of molecules having a monoisotopic mass of 500.000+/−0.600 Da has been found to be 534,676 and the number having a monoisotopic mass of 500.000+/−0.001 Da has been found to be 1828. It is clear that as the mass of the molecule increases the number of possible elemental compositions rapidly increases for the same mass measurement tolerance.

For the elements considered in FIG. 2 the maximum and minimum mass for any molecule with a nominal mass of 500 Da will fall within the range 500.000+/−0.600 Da. Hence, in the calculation for a search window of +/−0.6 Da the mass search window has not eliminated any elemental compositions that yield a molecule with a nominal mass of 500 Da. If the mass of the ion is measured to an accuracy of about +/−1 ppm (+/−one standard deviation or 68% confidence) then it would not be unreasonable to set a mass search window of +/−4 ppm or +/−0.002 Da. In this case the number of possible elemental compositions is reduced to 3662.

Column B in FIG. 2 tabulates the minimum and maximum number of atoms of the same elements that have been considered to be present in the molecule, and then tabulates the number of elemental compositions that have a monoisotopic molecular mass that falls within the indicated mass search window. In this instance it has been assumed that as a consequence of inspecting the molecular isotopic distribution, it has been possible to conclude that the molecule contains no atoms of chlorine or bromine. It will be seen that, as a consequence of this assumption, the number of possible elemental compositions is now approximately one quarter to one third that for each mass search window and where previously chlorine and bromine have not been eliminated from the calculation.

Column C in FIG. 2 tabulates the minimum and maximum number of atoms of the same elements that have been considered to be present in the molecule, and then tabulates the number of elemental compositions that have a monoisotopic molecular mass that falls within the indicated mass search window. In this instance it has been assumed that as a consequence of careful measurement of the molecular isotopic distribution, it has been possible to conclude that the molecule contains no atoms of chlorine or bromine and between 0 and 3 atoms of sulphur. It will be seen that, as a consequence of this assumption, the number of possible elemental compositions has reduced yet again for each mass search window, but in this case by only about 20%.

In this situation, where the mass has been accurately measured and the search window has been set to +/−4 ppm or +/−0.002 Da, the number of possible elemental compositions is reduced to 989. This is considerably less than the 3662 possible elemental compositions first calculated but is still a long way short of the target of just one possible elemental composition.

The tables shown in FIGS. 3 and 4 are the corresponding tables for molecules measured to have masses of 250.000 and 500.000 Dalton respectively, but include columns where it is assumed that the relative numbers of atoms of the different elements in the molecule have been determined to within a narrower range as a consequence of the measurements made according to the preferred embodiment described here.

The table in FIG. 3 is similar to that shown in FIG. 1, and the data in columns B and C of FIG. 3 are a direct reproduction of the data in columns B and C of FIG. 1 respectively. The data tabulated in column D of FIG. 3 assumes that the relative number of atoms of carbon, hydrogen, nitrogen, sulphur and phosphorus have been determined to an accuracy of approximately +/−40%. In other words, it has been assumed that the number of carbon atoms in each molecule falls between 5 and 10 inclusive, the number of hydrogen atoms falls between 8 and 14 inclusive, the number of nitrogen and sulphur atoms each fall between 1 and 3 inclusive and the number of phosphorus atoms falls between 1 and 2 inclusive. It has also been assumed that the measurements according to the preferred embodiment indicate that there are no atoms of fluorine, chlorine or bromine present in the molecule. No new assumptions have been made with regard to the number of oxygen atoms in the molecule. It can now be seen that the measurement of just the nominal mass leads to a calculation of the number of possible elemental compositions of only 27. A measurement of the mass to an accuracy of about +/−2 ppm (+/−one standard deviation or 68% confidence) thereby allowing a mass search window of +/−8 ppm or +/−0.002 Dalton is now adequate to uniquely define the elemental composition of the element. In this case the elemental composition is $C_7H_{11}N_2O_2PS_2$ which has a mass of 250.0000 Daltons.

It has been assumed above that it has not been possible to narrow the range of the number of oxygen atoms in the molecule since it has been assumed that the molecule has been fully oxidised or combusted in order to determine the relative amounts of the other elements in the molecule. However, if required, the molecule may alternatively be fully fluorinated in order to determine the relative number of oxygen atoms in the molecule. In column D in FIG. 3 it has been assumed that the measurement has also been carried out to determine the relative number of oxygen atoms present. This has been assumed to have been determined to be within the range 1 to 3 inclusive. It can be seen that the measurement of just the nominal mass now leads to a calculation of just 16 possible elemental compositions. However, in this case, this extra information has not changed the required accuracy of mass measurement needed to determine the actual, unique, elemental composition.

The table in FIG. 4 is similar to that in FIG. 2, and the data in columns B and C of FIG. 4 are a direct reproduction of the data in columns B and C of FIG. 2 respectively. The data tabulated in column D assumes that the relative number of atoms of carbon, hydrogen, nitrogen, sulphur and phosphorus have been determined to an accuracy of approximately +/−30%. In other words, it has been assumed that the number of carbon and hydrogen atoms in each molecule each fall between 13 and 22 inclusive, the number of nitrogen and phosphorus atoms each fall between 2 and 5 inclusive and the number of sulphur atoms falls between 1 and 2 inclusive. Again, it has been assumed that the measurements according to the preferred embodiment described here indicate that there are no atoms of fluorine, chlorine or bromine present in the molecule. No new assumptions have been made with regard to the number of oxygen atoms in the molecule. It can be seen that the measurement of just the nominal mass leads to a calculation of the number of possible elemental compositions of only 183. A measurement of the mass to an accuracy of about +/−1 ppm (+/−one standard deviation or 68% confidence), thereby allowing a mass search window of +/−4 ppm or +/−0.002 Dalton, leads to a calculation of 7 possible elemental compositions: This is considerably less than the previous best calculation of 989 possible elemental compositions, but is still not adequate to uniquely define the elemental composition of the element.

The data tabulated in column E of FIG. 4 assumes that the relative number of atoms of carbon, hydrogen, have been determined to a higher accuracy of approximately +/−15%. In other words, it has been assumed that the number of carbon and hydrogen atoms in each molecule now each fall between 15 and 20 inclusive. The number of nitrogen and phosphorus atoms are each assumed still to fall between 2 and 5 inclusive and the number of sulphur atoms is assumed still to fall between 1 and 2 inclusive. It can now be seen that the measurement of just the nominal mass leads to a calculation of only 60 possible elemental compositions. A measurement of the mass to an accuracy of about +/−1 ppm (+/−one standard deviation or 68% confidence), thereby allowing a mass search window of +/−4 ppm or +/−0.002 Dalton, leads to a calculation of just 2 possible elemental compositions. If the search window is reduced to +/−2 ppm or +/−0.001 Dalton (corresponding to +/−two standard deviations or 95% confidence) then this will uniquely define the elemental composition of the element. In this case the elemental composition is $C_{17}H_{17}N_3O_7P_3S$ which has a mass of 500.0000 Daltons.

These examples illustrate that the elemental composition of an organic molecule can be uniquely determined by a combination of accurate mass measurement of the molecule, a measurement to determine what elements are present in the molecule and a measurement of the approximately relative numbers of the atoms of the different elements present in the molecule. As the mass of the molecule increases, the required accuracy of measurement of the mass of the molecule and the required accuracy of determination of the approximately relative numbers of atoms of the different elements present increases in order to uniquely determine the elemental composition of the molecule.

A preferred embodiment of the present invention will now be described with reference to FIG. 5 which shows an Electron Impact ionisation source which has been modified according to a preferred embodiment of the present invention. A sample is preferably introduced into the source chamber 1 of the ion source in the gas phase via a sample introduction capillary tube 2. The ion source further comprises an electron beam 3, an exit plate 4 having an ion exit aperture 5 and a modified ion repeller electrode 6. The electron beam 3 is preferably confined by a magnetic field (not shown) which is preferably maintained in the direction of travel of the electrons. The ion repeller electrode 6 is preferably modified such that its surface is preferably coated with one or more oxidising reagents such as copper oxide (CuO) and/or nickel oxide (NiO) and/or zinc oxide (ZnO). The ion repeller electrode 6 preferably further comprises a heater element 7 for heating the ion repeller electrode 6. The surface of the ion repeller electrode 6 may according to an embodiment be coated with one or more chemical reagents such as a fluorinating reagent.

A sample is preferably introduced into the source chamber 1 via the sample introduction, capillary tube 2 which is preferably provided in an evacuated outer chamber. The sample may be introduced directly into the source chamber 1 or with the assistance of a carrier gas such as helium. The sample is preferably exposed to a high temperature oxidising surface of the ion repeller electrode 6 which preferably causes the sample to be oxidised to yield the oxides of the elements contained within the sample molecule. For example, carbon in the organic molecule is preferably converted to one or more oxides of carbon, preferably to carbon dioxide. Similarly, hydrogen is preferably converted to water and nitrogen is preferably converted to one or more oxides of nitrogen. Sulphur is preferably converted to one or more oxides of sulphur (e.g. sulphur dioxide) and phosphorus is preferably converted to one or more oxides of phosphorus. Fluorine is preferably converted to one or more oxides of fluorine (e.g. fluorine monoxide) and chlorine is preferably converted to one or more oxides of chlorine (e.g. chlorine dioxide). Bromine is preferably converted to one or more oxides of bromine or to free bromine. The resulting molecules of the oxidation process are then preferably ionised by electron impact ionisation with the electron beam 3 and the resultant ions are preferably extracted from the source chamber 1 through the ion exit aperture 5. The ions are then preferably passed on to a mass spectrometer for mass analysis.

The mass spectrometer downstream of the ion source may, for example, comprise a quadrupole mass filter or a quadrupole ion trap. However, a mass spectrometer capable of high resolution is particularly preferred since some of the product ions may have substantially the same nominal mass. For example, carbon dioxide ($CO_2$) and nitrous oxide ($N_2O$) both have a nominal mass of 44. However, their accurate masses are 43.990 and 44.001 respectively and hence these ions will be resolved at a mass resolution of 4000. According to the preferred embodiment a high resolution mass spectrometer may be provided such as a double focusing magnetic sector mass analyser, a Time of Flight ("TOF") mass analyser, an orthogonal acceleration Time of Flight ("oa-TOF") mass analyser, a Fourier Transform Ion Cyclotron Resonance ("FT-ICR") mass analyser or a Fourier Transform electrostatic trap mass analyser such as an Orbitrap® mass analyser. In particular, Time of Flight, FT-ICR and Orbitrap® instruments may be used as they have parallel detection characteristics and are capable of recording mass spectra with very high sensitivity.

According to the preferred embodiment the source chamber 1 is preferably heated, preferably to at least 400° C. The source chamber 1 is preferably contained in a vacuum chamber which is preferably maintained at a very low pressure. The vacuum is preferably maintained at a pressure of less than $10^{-6}$ mbar, preferably at a pressure of less than $10^{-7}$ mbar, further preferably at a pressure of less than $10^{-8}$ mbar, and further preferably at a pressure of less than $10^{-9}$ mbar. A high vacuum is preferred to minimise the residual background gas pressure which will contribute to the mass spectrum and which may interfere with the peaks resulting from oxidation of the sample. In particular, a background pressure of water will interfere with the water signal generated from the oxidation of the organic compound. The use of a carrier gas, such as helium, may advantageously be used to purge the source chamber 1 of residual background gas. The carrier or purging gas is preferably of high purity and is dry.

The oxidising reagent may slowly become degenerated and hence according to an embodiment of the present invention the oxidising surface may periodically be recharged. This may be accomplished by introducing oxygen via the sample or purging gas inlet line 2 for a period of time while the oxidising surface is preferably maintained at an appropriate temperature. This method of recharging is preferred to that of removing the electrode from the vacuum chamber since once the high vacuum is lost then it may take a considerable period of time to recover.

Analysis of the resultant mass spectrum enables an approximate determination of the elemental composition of the organic compound to be made. According to an embodiment the background spectrum due to the residual background gas may be subtracted in order to determine the true spectrum due to the oxidation of the organic compound. It may also be necessary to calibrate the response of the ionisation source and the mass analyser for each component in the mass spectrum by means of an appropriate reference material or standard. This will allow a response factor for each component to be determined and this in turn will allow each measurement to be corrected for different response factors. Once an approximate elemental composition has been determined this information may be used in combination with the measured mass of the molecules of the organic compound, or preferably the accurate measured mass of the organic compound, to determine the elemental composition of the organic compound.

An Electron Impact ionisation ion source according to an embodiment of the present invention which is shown in FIG. 5 comprises an ion repeller electrode 6 which has been modified to allow it to be heated. The surface of the electrode 6 comprises an oxidising reagent e.g. copper oxide. This design allows some of the organic material or sample to be directly ionised by electron impact rather than impact the high temperature oxidising surface 6 and then become oxidised.

Figure 6:
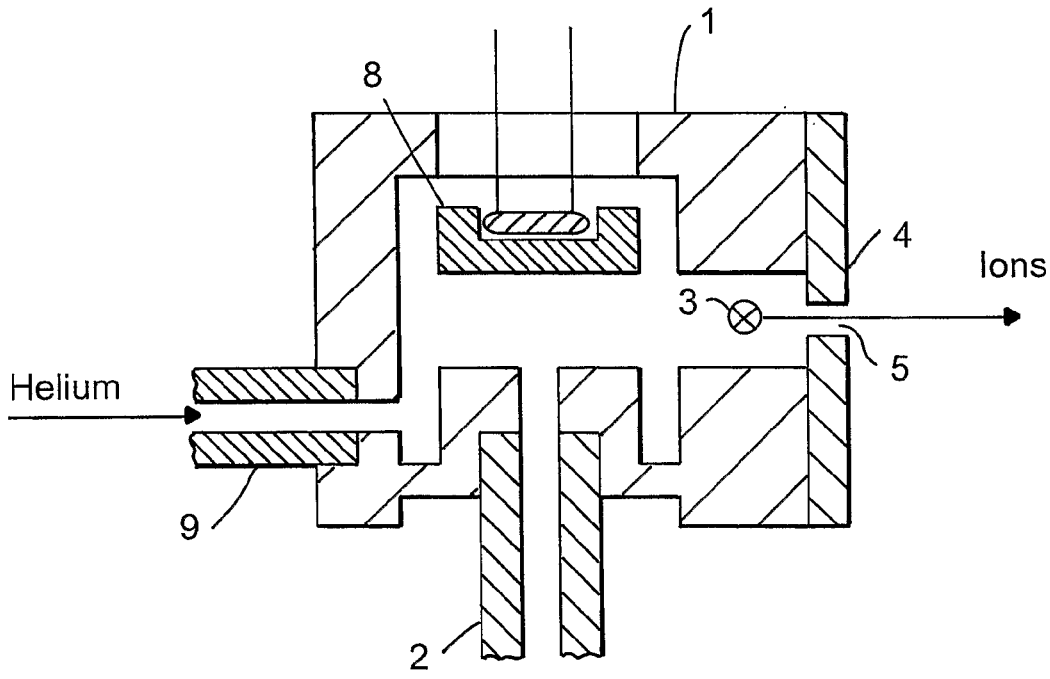
FIG. 6 shows another embodiment of the present invention wherein an additional capillary tube is provided.

FIG. 6 shows another embodiment wherein the sample is more likely to impact the high temperature oxidising surface rather than be directly ionised by electron impact ionisation. The ion source according to this embodiment comprises a source chamber 1, a sample introduction capillary tube 2, an electron beam 3 and an exit plate 4 having an ion exit aperture 5. The electron beam 3 is preferably confined by a magnetic field (not shown) which is preferably maintained in the direction of travel of the electrons. The sample is preferably introduced in the gas phase and is preferably directed towards a heated oxidising surface 8. The oxidising surface 8 may comprise one or more oxidising reagents such as copper oxide (CuO) and/or nickel oxide (NiO) and/or zinc oxide (ZnO). The oxidising surface may have a porous or sintered surface structure. In this embodiment the heated oxidising device has a form similar to that of a dispenser cathode and may be heated to at least 800° C. and preferably to 950° C. or higher. However, the main purpose of the heated surface 8 is to oxidise any organic molecules that impact its surface in contrast to a dispenser cathode which is primarily arranged to act as a source of thermally emitted electrons.

In the embodiment illustrated in FIG. 6 an additional capillary tube 9 may be provided to supply oxygen to recharge the heated oxidising surface 8 as and when required. The additional capillary tube 9 may also be used to deliver a purging gas, such as helium, in order to reduce the level of residual background gas. A mixture of oxidising and purging gas may also be introduced through the additional gas inlet capillary tube 9.

Figure 7:
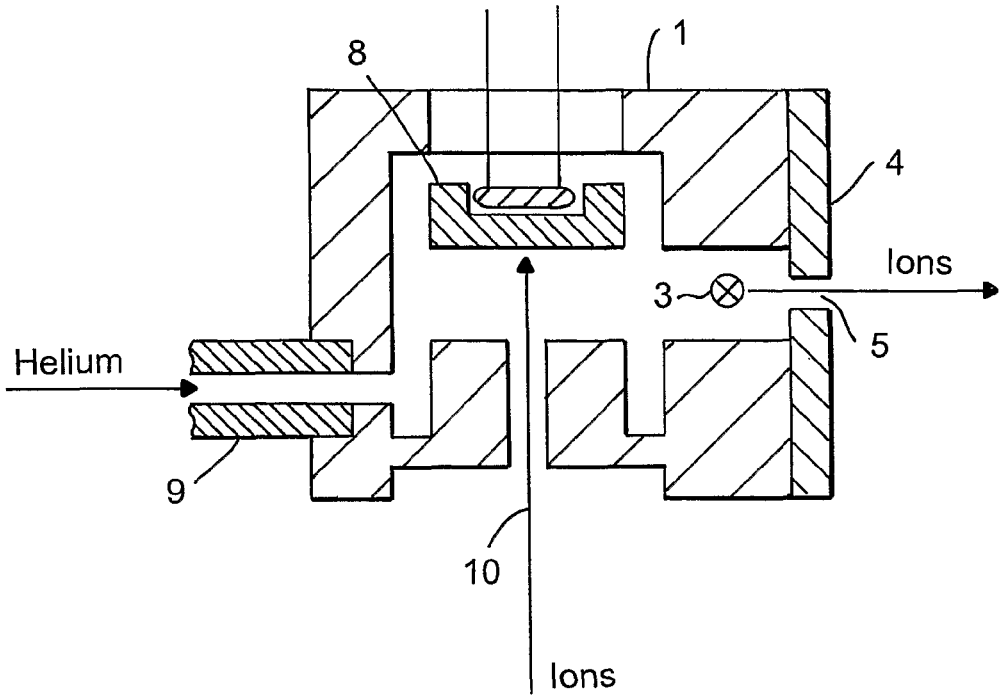
FIG. 7 shows another embodiment of the present invention wherein the sample is ionised and is introduced into the ion source as a beam of ions.

FIG. 7 shows another embodiment and is similar to that illustrated in FIG. 6 except than the organic sample material is ionised prior to oxidisation. The sample is preferably introduced to the heated oxidising surface 8 in the form of a beam of ions 10. The ion beam 10 may be focused such that the whole of the ion beam 10 substantially impacts the heated oxidising surface 8. The ion energy may be varied or controlled so that the ions impact the heated oxidising surface 8 with an optimum or preferred impact velocity. The electrical potentials on the source chamber 1, the modified dispenser cathode 8 which forms the heated oxidising surface 8 and on the source of organic sample ions (not shown) may be adjusted in order to provide the required ion beam focusing, ion image size and ion energy or velocity of impact.

Introduction of the organic sample material in the form of a beam of ions 10 allows a very significant increase in the range and variety of species that may be analysed according to the preferred embodiment of the present invention. Nearly all organic materials may be ionised and transmitted through a vacuum chamber regardless of the chemical polarity, volatility and stability of the organic material. An organic material needs to be reasonably volatile and stable and therefore have low or zero chemical polarity in order to be introduced in the gas phase into the embodiments illustrated in FIGS. 5 and 6. No such constraint exists when the organic material is ionised prior to introduction into the source chamber 1 in a manner as illustrated in FIG. 7.

Depending on the characteristics of the organic sample the sample material may be ionised by one or more of the following ionisation methods that may be used within a vacuum including Electron Impact ("EI") ionisation, Photo Ionisation ("PI") ionisation, Field Ionisation ("FI") ionisation, Field Desorption ("FD") ionisation, Chemical Ionisation ("CI") ionisation, Fast Atom Bombardment ("FAB") ionisation, Surface Ionisation Mass Spectrometry ("SIMS") ionisation, Liquid Surface Ionisation Mass Spectrometry ("LSIMS") ionisation or, Plasma Desorption ("PD") ionisation. Thermospray ionisation, Laser Desorption Ionisation ("LDI"), Matrix Assisted Desorption Ionisation ("MALDI") and Desorption Ionisation On Silica ("DIOS") ionisation may also be used.

Depending on the characteristics of the organic sample the material may be ionised by one or more ionisation methods at substantially atmospheric pressure. For example, Electrospray ionisation ("ESI"), Atmospheric Pressure Chemical Ionisation ("APCI"), Atmospheric Pressure Photo-Ionisation ("APPI"), Atmospheric Pressure Laser Desorption and Ionisation ("AP-LDI"), Atmospheric Pressure Matrix Assisted Laser Desorption and Ionisation ("AP-MALDI"), Desorption Electrospray Ionisation ("DESI"), Direct Analysis in Real Time ("DART"), Atmospheric Pressure Ionisation ("API"), $Ni^{63}$ ionisation and other sampling and ionisation techniques that may be used at atmospheric pressure may be used.

If the sample comprises a mixture of different organic compounds then it may first be separated into its components prior to ionisation. According to an embodiment separation techniques such as Gas Chromatography ("GC"), Liquid Chromatography ("LC"), Capillary Electrophoresis (CE), Capillary Electrophoresis Chromatography (CEC), Ion Mobility Separation ("IMS"), Differential Mobility Separation ("DMS"), Field Asymmetric Ion Mobility Separation ("FAIMS") and other techniques that may be interfaced directly to the ionisation source may be used. The process whereby the sample is ionised at atmospheric pressure by ionisation techniques such as Electrospray ionisation or Atmospheric Pressure Chemical Ionisation and wherein the resultant ions are then passed through into a first vacuum chamber of a mass spectrometer is known for interfacing liquid chromatography and capillary electrophoresis to mass spectrometry. According to an embodiment solvent is removed from organic samples that are in solution and therefore this process solves the problem of the need to remove solvent from organic sample material prior to analysis by mass spectrometry.

A further advantage of ionising the organic sample material prior to oxidising with a heated oxidising surface 8 is that the ion beam 10 may be filtered by mass to charge ratio and/or by ion mobility prior to analysis. An ion source may comprise a number of different ionic species. A mass filter such as a quadrupole mass filter, a magnetic sector or a Wien filter may be used to select just one ionic species of interest. Furthermore, if required, just one isotope peak from the ionic species of interest may be selected. The ability to select one isotope or another can be helpful in removing any ambiguities in the interpretation of a mass spectrum of the oxidised or fluorinated products of the organic molecule.

Another advantage of ionising the organic sample material prior to oxidising with a heated oxidising surface 8 is that the ion beam 10 may first be subjected to fragmentation to produce one or more characteristic fragment, daughter or product ions. The fragment or product ions may themselves be the subject of analysis. The fragment or product ions may be accurately mass measured and may also be submitted to elemental analysis according to the preferred method described here. Such species are not available for analysis by any other technology and the opportunity to submit such species to elemental analysis is particularly advantageous. Methods for fragmentation of ions include Collision Induced Decomposition ("CID") in a gas collision cell, preferably employing radial confinement of ions by means of RF ion guides. Other methods include Electron Capture Dissociation ("ECD"), Electron Transfer Dissociation ("ETD"), Surface Induced Decomposition ("SID") and other known methods employing reagent atoms, molecules, ions and/or metastable atoms, metastable molecules and metastable ions. Following fragmentation of sample ions it may be advantageous to select one fragment, daughter or product ion according to its mass to charge ratio and/or its ionic mobility prior to analysis according to a preferred method of the present invention. A mass filter, such as a quadrupole mass filter, a magnetic sector or a Wien filter may be used to select just one ionic species of interest. Alternatively, or in addition, an ion mobility separator may be used to select an ion of interest prior to analysis.

Figure 8A:
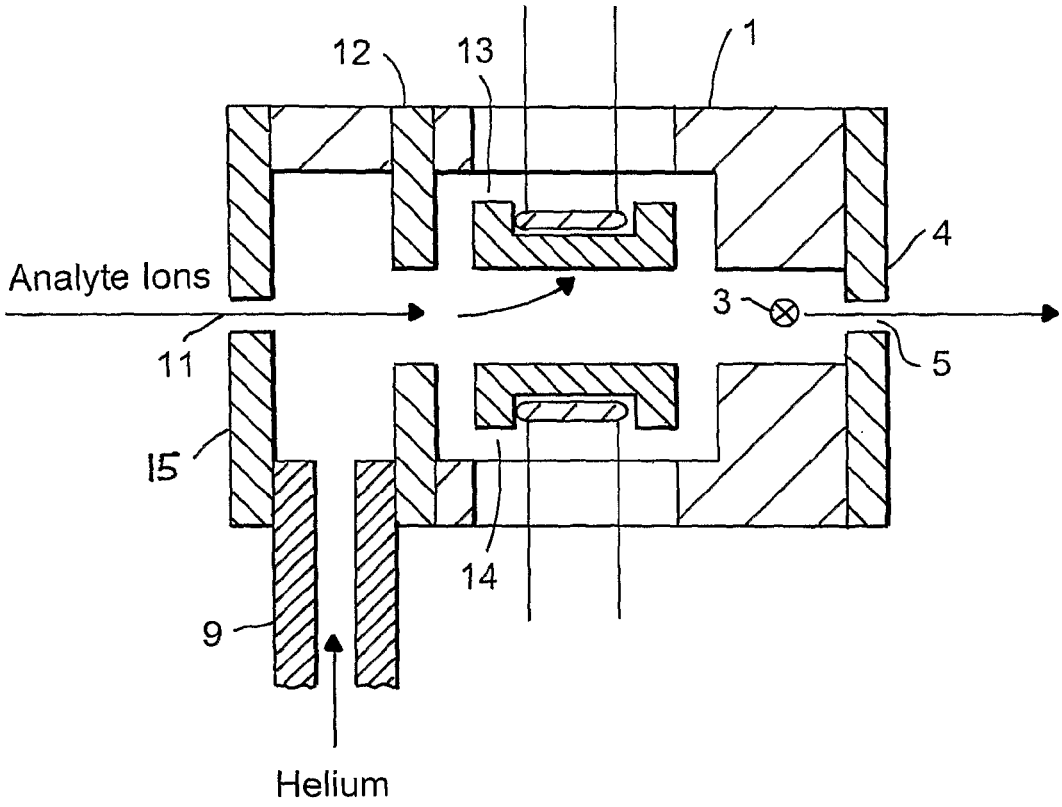
FIG. 8A shows another embodiment of the present invention wherein the sample is ionised and is introduced into the ion source as a beam of ions which is then directed onto a heated reactive surface and FIG. 8B shows an embodiment of the present invention wherein the sample is ionised and is introduced into the ion source as a beam of ions which is then transmitted through the ion source without being directed onto a heated reactive surface.
Figure 8B:
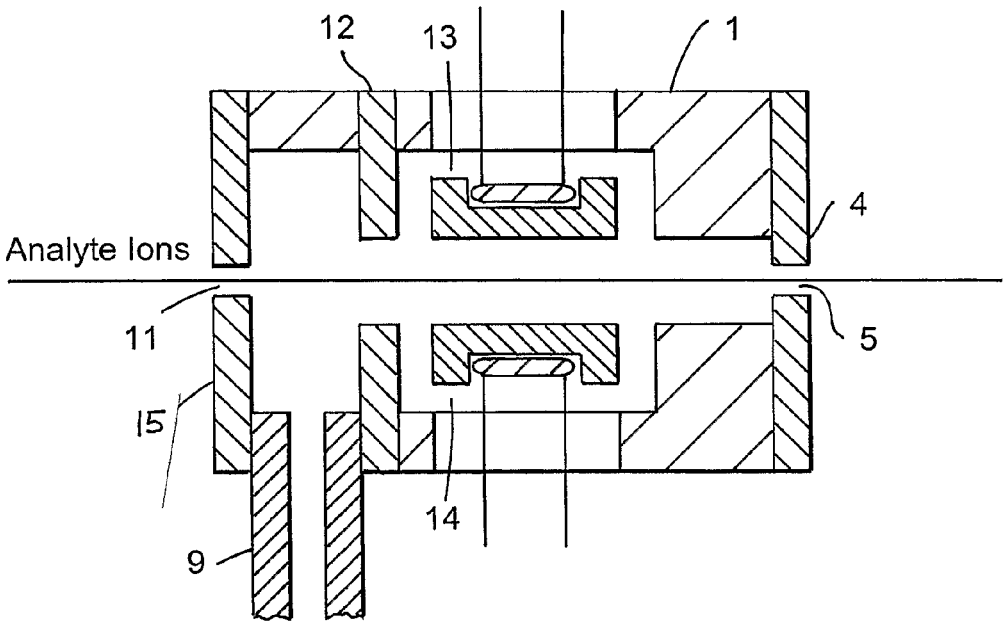

FIGS. 8A and 8B show another embodiment employing two modified dispenser cathodes for heating oxidising surfaces 13,14. According to an embodiment the sample is preferably ionised and is preferably introduced as a beam of ions 11 that may be transmitted straight through the device in a mode of operation (see FIG. 8B). Alternatively, the beam of ions may be diverted onto one of the heated oxidising surfaces 13 (see FIG. 8A). The ion source preferably comprises a heated source chamber 1, an electron beam 3 which may be radially confined by an axial magnetic field (not shown), an ion exit plate 4 having an ion exit aperture 5, a gas inlet capillary tube 9 for introduction of oxygen and/or a purging gas such as helium, an ion entrance plate 15 having an ion entrance aperture, an ion beam focusing and deflection pair of electrodes 12, and two modified dispenser electrodes 13 and 14 to provide the heated oxidising surfaces.

In FIG. 8A the organic material to be analysed is ionised and is then introduced into the source chamber 1 via the ion entrance aperture. The ions are focused and directed by the electrodes 12 onto the heated oxidising surface of the modified dispenser cathode 13. The ion beam 11 may be deflected towards the modified dispenser cathode 13 by application of appropriate voltages to the ion source. For example, appropriate voltages may be applied to the ion entrance plate 15 and/or to the focusing/steering electrodes 12 and/or to the two modified dispenser electrode surfaces 13,14 and/or the source chamber 1. The ion impact energy or velocity onto the heated oxidising surfaces 13,14 may be controlled or optimised by appropriate adjustment of the voltages applied to ion entrance plate 15 and/or the focussing steering electrodes and/or the electrode surfaces 13,14 and/or the source chamber 1. The heated oxidising surfaces 13,14 preferably comprise an oxidising reagent, such as copper oxide, and are preferably porous or sintered such that the ions of organic molecules preferably adhere to the surface long enough to allow time for oxidation of the molecule. The ion impact energy is preferably sufficient to implant the organic ions into the surface layers of the oxidising surface 13,14 and to induce fragmentation of the organic ions prior to oxidisation. The oxidised products are gases at the temperature of the heated surface 13,14. The resulting gas molecules preferably leave the heated surface and are carried along with the carrier gas, preferably helium, for ionisation by electron impact with the beam of electrons 3. The resulting product ions leave the source chamber 1 via the ion exit aperture 5 and are passed on to a mass spectrometer for mass analysis.

The mass spectrometer downstream of the ion source may comprise a quadrupole mass filter or a quadrupole ion trap. However, a mass spectrometer capable of high resolution may be provided since some of the product ions may have the same nominal mass. Such high resolution mass spectrometers include double focusing magnetic sector mass analysers, Time of Flight ("TOF") mass analysers, orthogonal acceleration Time of Flight ("oa-TOF") mass analysers, Fourier Transform Ion Cyclotron Resonance ("FT-ICR") mass analysers and Fourier Transform electrostatic trap mass analysers such as an Orbitrap® mass analyser.

In FIG. 8B the organic material to be analysed is preferably ionised and introduced into the source chamber 1 via an ion entrance aperture 11 and may in a mode of operation pass straight through the ion chamber 1 and leave the ion chamber 1 via an ion exit aperture 5. The ions are then preferably passed on to a mass spectrometer for mass measurement. The mass or mass to charge ratio of the organic sample ions are preferably measured to a high accuracy by a mass spectrometer which is preferably capable of accurate mass measurement. The mass spectrometer may comprise a double focusing magnetic sector mass spectrometer, a Time of Flight ("TOF") mass analyser, an orthogonal acceleration Time of Flight ("oa-TOF") mass spectrometer, a Fourier Transform Ion Cyclotron Resonance ("FT-ICR") mass spectrometer or a Fourier Transform electrostatic trap mass analyser such as an Orbitrap® mass analyser.

According to a preferred embodiment the ion source chamber 1 is preferably heated, preferably to at least 400° C., and is preferably contained in a vacuum chamber which is preferably maintained at a very low pressure. The vacuum may, for example, be maintained at a pressure of less than $10^{-7}$ mbar, preferably at a pressure of less than $10^{-8}$ mbar, and further preferably at a pressure of less than $10^{-9}$ mbar. A high vacuum is preferably provided in order to minimise the residual background gas pressure and in particular the partial pressure of water. A high purity and dry carrier gas, such as helium, may advantageously be used to purge the ion source chamber 1 of residual background gas.

Analysis of the mass spectrum of the oxidised organic sample allows an approximate determination of the elemental composition of the organic compound to be made. It may be necessary to subtract the background spectrum due to the residual background gas and to correct the measured peak intensities to allow for different response factors due differences in ionisation, mass analyser transmission and detection efficiencies. The approximate elemental composition may then be used in combination with the measured mass or mass to charge ratio, preferably the measured accurate mass or mass to charge ratio, of the organic compound of interest to determine its elemental composition.

An advantage of the embodiment illustrated in FIGS. 8A and 8B is that the same mass spectrometer may be used for both the measurement of the mass or mass to charge ratio of the organic sample molecules and for the analysis of the products of oxidation of the same organic molecules in order to determine its approximate elemental composition. The mass spectrometer may be fitted with one or more ionisation sources, either at atmospheric pressure or in vacuum, as mentioned above, and may be interfaced to one or more separations techniques as mentioned above. The mass spectrometer may include one or more ion guides, one or more regions for fragmentation of ions, one or more mass filters, one or more ion mobility separators, or any combination thereof, arranged upstream of the preferred oxidation device illustrated in FIGS. 8A and 8B. The mass spectrometer preferably arranged downstream of the preferred ion source 1 is preferably capable of high mass resolution and is preferably capable of accurate mass measurement.

An additional advantage of the embodiment illustrated in FIGS. 8A and 8B is that the device contains two modified dispenser cathodes 13,14 which may be used alternately. Both dispenser cathodes 13,14 may be modified to provide a heated oxidising surface. Alternatively, one modified dispenser cathode 13;14 may be modified to provide a heated oxidising surface and the other modified dispenser cathode 13;14 may be modified to provide a different chemical reaction. For example, the second modified dispenser cathode 14 may be modified in order to fluorinate organic molecules or to chlorinate organic molecules. This allows a second method of elemental analysis of the organic molecules to be performed which is particularly useful when the method of oxidisation alone provides insufficient information or the background at one or more mass numbers is excessive. The use of different chemical reagents allows the generation of different product ions which may be more suitable and/or more informative. The product ions may experience less mass interference and/or less background interference.

Figure 9:
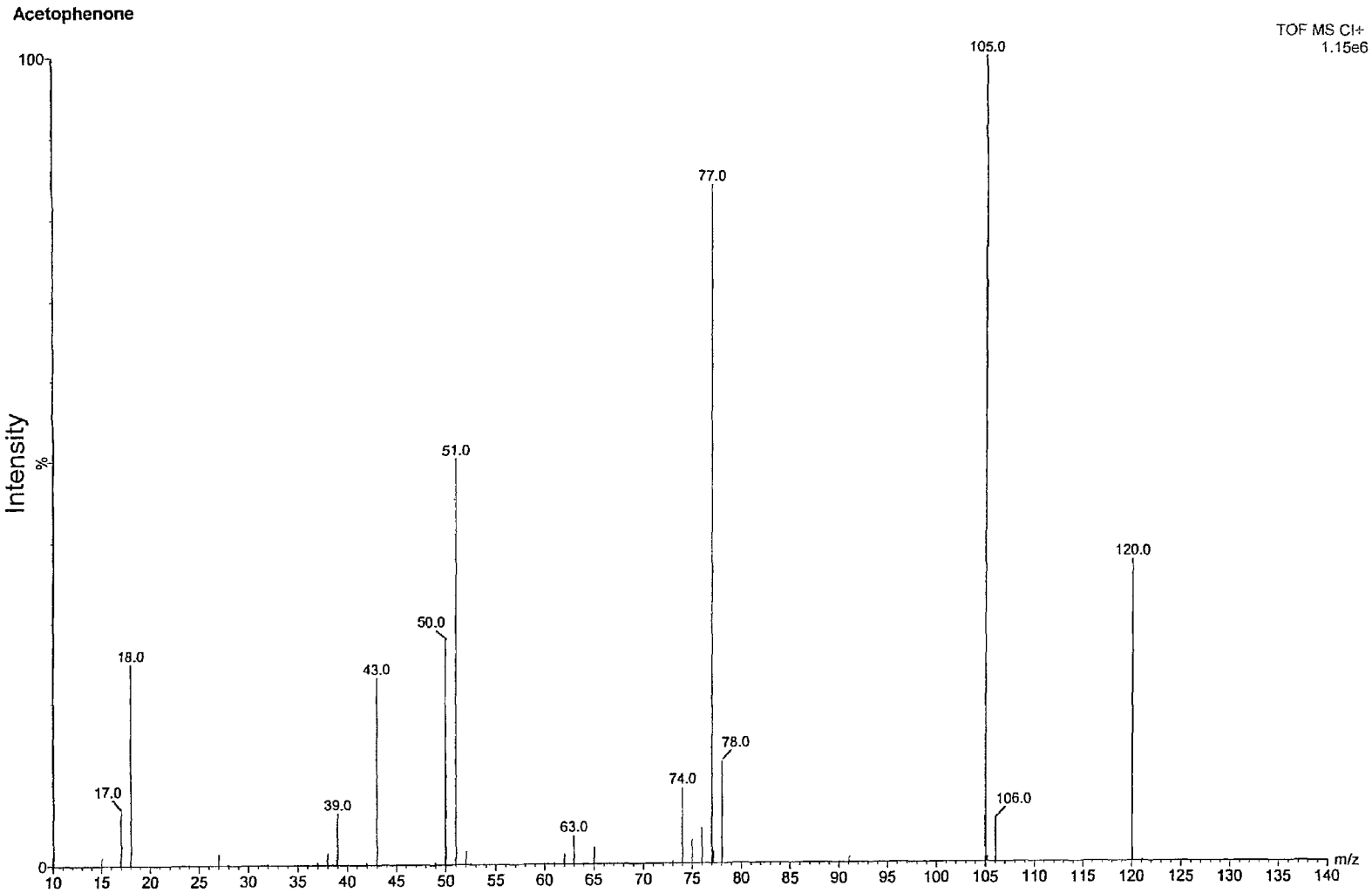
FIG. 9 shows a mass spectrum for acetophenone obtained by electron impact ionisation with 70 eV electrons in the absence of a heated reacting surface.

FIGS. 9, 10 and 11 show mass spectra acquired using an ion source similar to that shown in FIG. 5. An Electron Impact ("EI") ion source of a GC TOF-MS mass spectrometer was modified by replacing the stainless steel ion repeller with an ion repeller 6 made of copper and having an end diameter of 5.8 mm. The ion repeller 6 was modified to allow a heater element to be inserted within the body of the ion repeller 6 in a manner substantially as shown in FIG. 5. The heater was made from a 120 mm length of 0.25 mm diameter tantalum wire wound back and forth through a 6-bore ceramic tube. The heater current was varied between 0 and 1.9 amps. A thermocouple was attached to the end of the ion repeller 6 at the opposite end to the end adjacent to the electron beam 3. The electron impact ion source chamber 1 was also heated up to a temperature of 400° C. When the ion source chamber 1 was heated to 400° C. a thermocouple attached to the ion repeller 6 registered a temperature of about 700° C. when the heater current was 1.9 amps. It is expected that, under these conditions, the temperature of the copper ion repeller 6 at the end adjacent to the electron beam 3 was in excess of 700° C.

In order to test the combustion of an organic molecule in the vacuum system of a mass spectrometer, experiments were carried out using acetophenone. Acetophenone is a liquid at room temperature but it is quite volatile and when a small volume is introduced into an evacuated reservoir heated to 100° C. then it becomes gaseous. FIG. 9 shows a mass spectrum for acetophenone obtained according to an embodiment of the present invention by ionising acetophenone by Electron Impact ("EI") ionisation with 70 eV electrons. The spectrum was recorded when the ion source temperature was 200° C. and the copper ion repeller 6 was heated to 350° C. It may be noted that the Electron Impact spectrum of acetophenone does not include peaks at mass to charge ratio 44 or at mass to charge ratio 28.

In order to produce a copper oxide (CuO) surface to the copper ion repeller 6, oxygen was introduced into the ion source 1 through the gas inlet line normally used for introducing CI reagent gas. The temperature at which copper oxide thermally decomposes under vacuum is known to be significantly lower than that at atmospheric pressure (see Thermal decomposition of cupric oxide in vacuo; *Proc. Phys. Soc.*, B70, 1005-1008, 1957) and as a consequence it was not certain that the copper could effectively be oxidised under vacuum. Hence, in order to oxidise the copper surface it was exposed to a low pressure of oxygen gas at a series of different temperatures. The oxygen pressure measured on a Penning gauge in the vacuum housing was $10^{-5}$ mbar and it was estimated that the oxygen pressure within the ion source chamber 1 was about $10^{-3}$ mbar. The ion source chamber 1 and the ion repeller 6 were heated to about 400° C. for about an hour. The temperatures were then reduced to about 300° C. for a further hour and then further reduced to about 200° C. for a further hour. The flow of oxygen gas into the source was then switched off.

Acetophenone ($C_8H_8O$) was then introduced continuously into the ion source 1 from a heated reservoir through a heated fine capillary 2. The ion source chamber 1 was maintained at 200° C. Spectra were recorded every two seconds whilst the copper/copper oxide ion repeller 6 was progressively heated from 200° C. to 700° C. over a period of approximately 20 minutes.

Figure 10A:
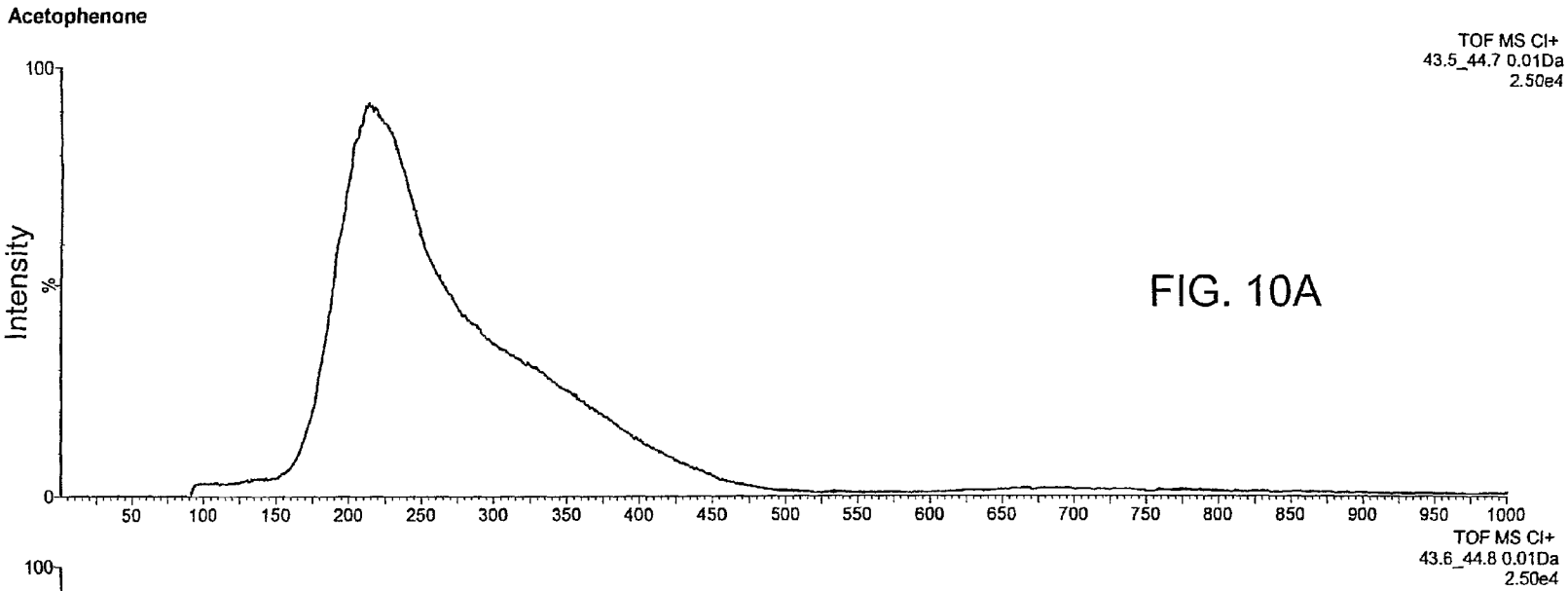
FIG. 10A shows a chromatogram for mass to charge ratio 44 (carbon dioxide) when a copper/copper oxide surface is heated from 200° C. to 700° C. in the presence of acetophenone

FIG. 10A shows a profile for carbon dioxide having a mass to charge ratio of 44 during the course of the experiment. Acetophenone was introduced at a time corresponding to scan number 90 and the heater current was increased in steps from 0.8 amps at a time corresponding to scan number 150 to 1.9 amps at a time corresponding to scan number 750. The heater current was then held at 1.9 amps for a further 10 minutes. It can be seen that a small signal corresponding to carbon dioxide is present as soon as the acetophenone is introduced. This ion current increases when the ion repeller 6 is heated reaching a maximum at scan number 215 for which the indicated temperature of the ion repeller was approximately 325° C. The carbon dioxide signal then declines to approximately zero at a time corresponding to scan number 500 for which the indicated ion repeller 6 temperature was approximately 500° C.

Figure 11A:
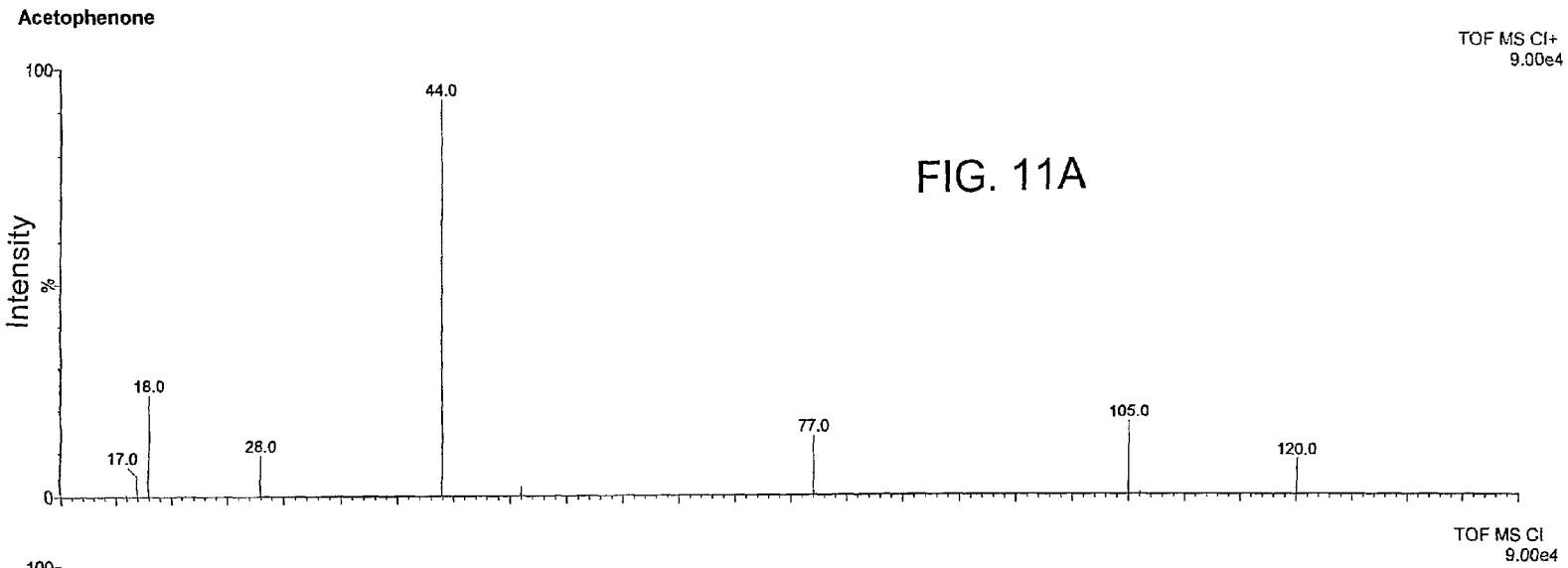
FIG. 11A shows a background subtracted spectra for acetophenone when a copper/copper oxide surface is heated to approximately 325° C.

FIG. 11A shows the background subtracted spectrum at the time for which the intensity of the carbon dioxide signal was a maximum. This was obtained by subtracting the background spectrum at the end of the experiment at which time the carbon dioxide signal had decayed to zero. Hence, FIG. 11A shows the difference in spectra for when carbon dioxide is being produced in the ion source 1 and when it is not.

Figure 10B:
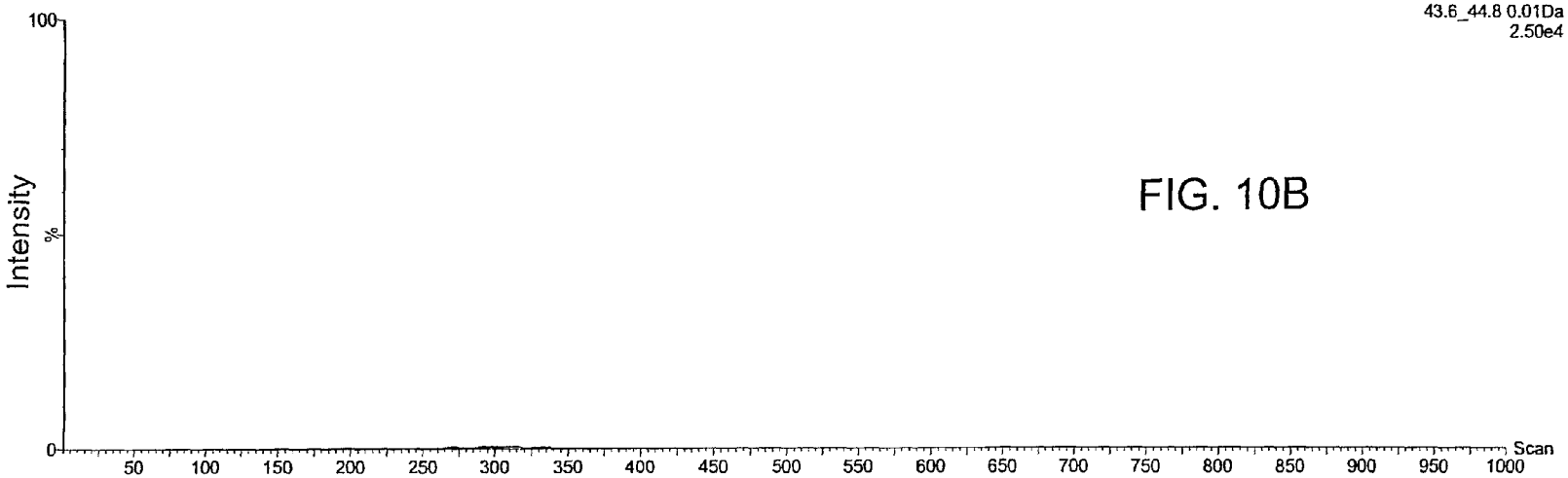
FIG. 10B shows a corresponding chromatogram for mass to charge ratio 44 (carbon dioxide) when a copper surface is heated from 200° C. to 700° C. in the presence of acetophenone.
Figure 11B:
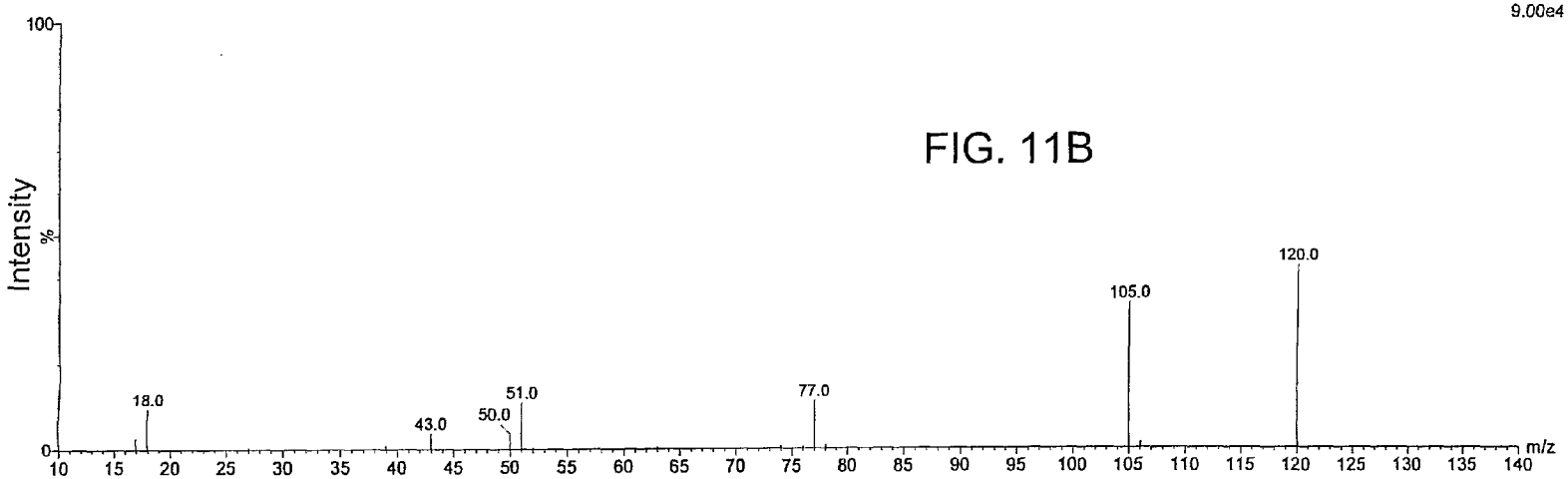
FIG. 11B shows a corresponding background subtracted spectra for acetophenone when a copper surface is heated to approximately 325° C.

For comparison, the same experiment was repeated, but without the process of introducing oxygen in order to oxidise the copper ion repeller 6. FIG. 10B shows the corresponding profile for carbon dioxide and FIG. 11B shows the corresponding background subtracted spectrum. Apart from omitting the oxidation procedure, the rest of the experimental procedure was the same as in the first experiment, with the same programming of the ion repeller heater current with respect to scan number. The chromatogram in FIG. 10B and the spectrum in FIG. 11B are plotted on the same scales as the corresponding chromatogram and spectrum as shown in FIGS. 10A and 11A respectively.

Comparison of the chromatogram for carbon dioxide shown in FIG. 10A and the chromatogram for carbon dioxide shown in FIG. 10B show a very distinct difference in behaviour. The presence of a carbon dioxide signal only in FIG. 10A suggests that the acetophenone is at least partially combusted to yield carbon dioxide only when the copper ion repeller surface has been oxidised and is heated to between 200° C. to 400° C.

Comparison of the two background subtracted spectra shown in FIGS. 11A and 11B also show a clear difference. In comparison to the spectrum in FIG. 11B, the spectrum in FIG. 11A shows small decreases in the peaks due to the electron impact ionisation of acetophenone (principally at mass to charge ratios of 120, 105, 77, 51, 50 and 43) and the appearance of peaks at mass to charge ratio 44 (due to carbon dioxide) and at mass to charge ratio 28 (due to carbon monoxide). In addition, there is an increase in the peaks at mass to charge ratio 18 and 17 due to the presence of water. These differences in the two spectra show the partial conversion of acetophenone into the oxides of carbon and hydrogen, whilst under vacuum, due to the presence of a heated surface of copper/copper oxide.

The lower temperature at which the copper oxide appears to decompose thermally in vacuum, when compared with its thermal decomposition at atmospheric pressure is in agreement with the observations reported by Goswami and Trehan (Thermal decomposition of cupric oxide in vacuo; *Proc. Phys. Soc.*, B70, 1005-1008, 1957). The use of other oxide surfaces with higher temperatures of thermal decomposition in vacuum may be preferred. The presence of a background signal due to the presence of water illustrates a difficulty with this method. According to an embodiment a heated fluorinating reactive surface may be used in order to overcome this difficulty.

The prime objective of the preferred embodiment of the present invention is to provide a universal means for determining the approximate elemental composition of organic compounds, with improved sensitivity and improved speed, and to use this information along with a measurement of the mass of the organic molecules in question to determine their elemental composition. However, the preferred embodiment of the present invention may also be used to measure the isotope ratio of the elements in organic compounds. The organic compound is preferably oxidised to the oxides of the constituent elements and these may be submitted to mass analysis. Alternatively, the organic compound may be fluorinated or chlorinated. This also allows measurement of the isotope ratios of the constituent elements.

The ion sources according to embodiments of the present invention as illustrated in FIGS. 7 and 8 provide a very versatile method of the isotopic analysis of organic molecules, since the organic sample is first ionised before oxidation. Nearly all organic materials may be ionised and transmitted through a vacuum chamber regardless or the chemical polarity, volatility and stability of the organic material. An organic material needs to be reasonably volatile and stable and therefore commonly of low or zero chemical polarity in order to be introduced in the gas phase into an ion source according to embodiments as illustrated in FIG. 5 and FIG. 6. No such constraint exists when the organic material is ionised prior to introduction into the ion source as illustrated in FIGS. 7 and 8.

Furthermore, if the sample comprises a mixture of different organic compounds then it may first be separated into its components prior to ionisation. Such separation techniques include Gas Chromatography ("GC"), Liquid Chromatography ("LC"), Capillary Electrophoresis ("CE") and other well known techniques. The process whereby the sample is ionised at atmospheric pressure by ionisation techniques such as Electrospray Ionisation ("ESI") and Atmospheric Pressure Chemical Ionisation ("APCI") is a well established method for interfacing liquid chromatography and capillary electrophoresis to mass spectrometry. This process incorporates the stage of removing the solvent from organic samples that are in solution and therefore inherently solves the problem of removing solvent from organic sample material prior to analysis of the isotope ratios of its constituent elements.

In applications where it is required to measure isotope ratios it is generally preferred to use a magnetic sector mass spectrometer fitted with several detectors, one for each isotope mass to be measured. This allows all the required isotope peaks to be measured simultaneously. However, isotope ratio measurements may also be made using a quadrupole mass spectrometer or another type of mass spectrometer.

Although the present invention has been described with reference to preferred embodiments, it will be understood by those skilled in the art that various changes in form and detail may be made without departing from the scope of the invention as set forth in the accompanying claims.

The invention claimed is:

1. An ion source for use with a mass spectrometer or elemental analyser comprising:

a source chamber;

a first device located within said source chamber which has at least one surface that is arranged and adapted to at least in part oxidise, fluorinate, chlorinate or halogenate sample ions which are introduced, in use, into said source chamber and come into contact with the at least one surface; and a device for generating an electron beam, wherein said electron beam is arranged to ionise at least some gaseous products resulting from the sample ions impacting the surface in said first device and becoming oxidised, fluorinated, chlorinated or halogenated and to send resulting product ions to the mass spectrometer or elemental analyser for analysis.

2. An ion source as claimed in claim 1, further comprising a second device located within said source chamber which is arranged and adapted to at least in part oxidise, fluorinate, chlorinate or halogenate a sample which is introduced, in use, into said source chamber.

3. An ion source as claimed in claim 2, wherein said second device is spaced apart from said first device or comprises a separate region or portion of said first device.

4. An ion source as claimed in claim 1, wherein said source chamber is located in a vacuum chamber which is maintained, in use, at a pressure selected from the group consisting of: (i) $\leq 10^{-5}$ mbar; (ii) $\leq 10^{-6}$ mbar; (iii) $\leq 10^{-7}$ mbar; (iv) $\leq 10^{-8}$ mbar; and (v) $\leq 10^{-9}$ mbar.

5. An ion source as claimed in claim 1, wherein the at least one surface of said first device comprises one or more oxidising reagents for oxidising said sample.

6. An ion source as claimed in claim 1, wherein the at least one surface of said first device comprises a catalytic material or is porous or sintered.

7. An ion source as claimed in claim 1, wherein said first device comprises a heating element for heating the at least one surface of said first device to a temperature selected from the group consisting of: (i) ≥150°; (ii) ≥200°; (iii) ≥250°; (iv) ≥300°; (v) ≥350°; (vi) ≥400°; (vii) ≥450°; (viii) ≥500°; (ix)? 550°; (x) ≥600°; (xi) ≥650°; (xii) ≥700°; (xiii) ≥750'; (xiv) ≥800°; (xv) ≥850°; (xvi) ≥900°; (xvii) ≥950°; and (xviii) ≥1000'.

8. An ion source as claimed in claim 1, further comprising a first capillary or introduction tube through which:

(i) a sample in a liquid or gaseous state is introduced, in use, into said source chamber; or (ii) a purging gas is introduced in a mode of operation prior to, with or subsequent to the introduction of said sample into said source chamber; or (iii) oxygen, fluorine, chlorine or a halogen is introduced in a mode of operation in order to recharge the at least one surface of said first device.

9. An ion source as claimed in claim 1, further comprising a first ion inlet through which the sample ions are introduced, in use, into said ion source.

10. An ion source as claimed in claim 1, further comprising one or more electrodes for directing the sample ions onto said first device.

11. A mass spectrometer or an elemental analyser comprising an ion source, wherein said ion source comprises:

a source chamber;

a first device located within said source chamber which has at least one surface that is arranged and adapted to at least in part oxidise, fluorinate, chlorinate or halogenate sample ions which are introduced, in use, into said source chamber and come in contact with the at least one surface; and a device for generating an electron beam, wherein said electron beam is arranged to ionise at least some gaseous products resulting from the sample ions impacting the surface in said first device and becoming oxidised, fluorinated, chlorinated or halogenated and to send resulting product ions to the mass spectrometer or elemental analyser for analysis.

12. A method of ionising a sample in a source chamber comprising:

introducing sample ions into said source chamber;

causing the sample ions to impact at least one surface located within a first device located within said source chamber to at least in part oxidise, fluorinate, chlorinate or halogenate said sample ions; and generating an electron beam, wherein said electron beam ionises at least some gaseous products resulting from said sample ions impacting said at least one surface within said first device and becoming oxidised, fluorinated, chlorinated or halogenated to form product ions; and analyzing the product ions with a mass spectrometer or elemental analyser.

13. An apparatus for generating gas products to be analysed by a mass spectrometer or elemental analyser comprising:

a source chamber;

a first ion inlet through which sample ions are introduced, in use, into said source chamber;

a first device located within said source chamber including at least one surface which is arranged and adapted to at least in part oxidise, fluorinate, chlorinate or halogenate said sample ions, wherein said source chamber is located in a vacuum chamber which is maintained, in use, at a pressure selected from the group consisting of: (i) $\leq 10^{-5}$ mbar; (ii) $\leq 10^{-6}$ mbar; (iii) $\leq 10^{-7}$ mbar; (iv) $\leq 10^{-8}$ mbar; and (v) $\leq 10^{-9}$ mbar; and a device for generating an electron beam, wherein said electron beam is arranged to ionise at least some gaseous products resulting from said sample ions impacting said at least one surface and becoming oxidised, fluorinated, chlorinated or halogenated.

14. A method comprising:

introducing sample ions into a source chamber;

using a surface of a first device located within said source chamber to at least in part oxidise, fluorinate, chlorinate or halogenate said sample ions, wherein said source chamber is located in a vacuum chamber which is maintained at a pressure selected from the group consisting of: (i) $\leq 10^{-5}$ mbar; (ii) $\leq 10^{-6}$ mbar; (iii) $\leq 10^{-7}$ mbar; (iv) $\leq 10^{-8}$ mbar; and (v) $\leq 10^{-9}$ mbar; and generating an electron beam, wherein said electron beam is arranged to ionise at least some gaseous products resulting from said sample ions impacting the surface of said first device and becoming oxidised, fluorinated, chlorinated or halogenated.

* * * * *